US010933642B2

(12) United States Patent
Arima et al.

(10) Patent No.: US 10,933,642 B2
(45) Date of Patent: Mar. 2, 2021

(54) INK JET RECORDING APPARATUS

(71) Applicant: Hitachi Industrial Equipment Systems Co., Ltd., Tokyo (JP)

(72) Inventors: Takahiro Arima, Tokyo (JP); Sho Mizoguchi, Tokyo (JP); Mamoru Okano, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 0 days.

(21) Appl. No.: 16/515,680

(22) Filed: Jul. 18, 2019

(65) Prior Publication Data

US 2020/0101741 A1 Apr. 2, 2020

(30) Foreign Application Priority Data

Sep. 27, 2018 (JP) ..... JP2018-181412

(51) Int. Cl.
*B41J 2/165* (2006.01)
*B41J 2/08* (2006.01)
*B41J 2/185* (2006.01)

(52) U.S. Cl.
CPC ..... *B41J 2/1652* (2013.01); *B41J 2/08* (2013.01); *B41J 2/185* (2013.01); *B41J 2002/16502* (2013.01)

(58) Field of Classification Search
CPC ... B41J 2/1652; B41J 2/08; B41J 2/185; B41J 2002/16502; B41J 2/1707;
(Continued)

(56) References Cited

U.S. PATENT DOCUMENTS 6,250,736 B1 * 6/2001 Wojcik ..... B41J 2/16544 347/28
7,150,512 B2 12/2006 Levin et al.
(Continued)

FOREIGN PATENT DOCUMENTS

CN 106808799 A 6/2017
JP 2011-861 A 1/2011
(Continued)

OTHER PUBLICATIONS

Extended European Search Report issued in European Application No. 19198397.2 dated Feb. 13, 2020 (11 pages).

*Primary Examiner* — Huan H Tran
*Assistant Examiner* — Alexander D Shenderov
(74) *Attorney, Agent, or Firm* — Crowell & Moring LLP

(57) ABSTRACT

An ink jet recording apparatus includes an ink container in which ink to be used to perform printing on a print target is stored, a nozzle which is connected to the ink container and from which pressurized and supplied ink is jetted, charging electrodes that charge ink particles jetted from the nozzle with electricity, deflecting electrodes that polarize the ink particles charged with electricity by the charging electrodes, a gutter that recovers ink not used for printing, a solvent container in which a solvent is stored, and a liquid nozzle which is connected to the solvent container and from which a pressurized and supplied solvent is jetted. The liquid nozzle includes a liquid flow passage portion that extends from the nozzle in a direction of the gutter, and a liquid jet hole that is formed at an angle allowing the pressurized and supplied solvent to hit the nozzle through the liquid flow passage portion.

22 Claims, 18 Drawing Sheets

(58) Field of Classification Search
CPC .... B41J 2002/16555; B41J 2/175; B41J 2/18; B41J 29/02; B41J 2/16552; B41J 2002/1853
USPC ..... 347/28
See application file for complete search history.

(56) References Cited

U.S. PATENT DOCUMENTS

2009/0189960 A1* 7/2009 Matsuda ..... B41J 2/03 347/77
2012/0299993 A1* 11/2012 Steuer ..... B41J 2/16505 347/28

FOREIGN PATENT DOCUMENTS

WO WO 2011/100517 A1 8/2011
WO WO 2018/105714 A1 6/2018

* cited by examiner

INK JET RECORDING APPARATUS

BACKGROUND OF THE INVENTION

1. Field of the Invention

The present invention relates to an ink jet recording apparatus that continuously ejects ink from a nozzle to perform printing on a medium to be printed.

2. Description of the Related Art

There is JP 2011-861 A as the related art regarding the field of the invention. JP 2011-861 A discloses a stop processing method for an ink jet recording apparatus. The ink jet recording apparatus includes an ink supply flow passage that is connected between an ink container and a nozzle and supplies ink stored in the ink container to the nozzle, a solvent supply flow passage that is connected between a solvent container and the nozzle and supplies a solvent to the nozzle, a recovery flow passage that is connected between a gutter for recovering ink not used for printing and the ink container and recovers liquid recovered by the gutter to the ink container, and a suction flow passage that is connected between an inflow portion of the nozzle and the ink container and guides liquid to the ink container. When the supply of ink to the nozzle is to be stopped from a print state where ink is being jetted from the nozzle, the stop processing method includes a cleaning step for the suction flow passage that supplies a solvent to the suction flow passage from the solvent supply flow passage, a residual liquid-suction step of sending a solvent present in the suction flow passage to the ink container by sucking outside air into the suction flow passage from the nozzle to make air flow in the suction flow passage, and a finish-cleaning step of making a solvent flow into the suction flow passage from the solvent supply flow passage in a state where a solvent present in the suction flow passage is replaced with air.

Further, there is WO 2018/105714 A. WO 2018/105714 A discloses an ink jet recording apparatus including a nozzle that is used to perform printing on a medium to be printed by jetting ink, a print head that receives deflecting electrodes polarizing the jetted ink by an electrostatic force, and an ink suction unit that sucks floating ink by an electrostatic force.

In JP 2011-861 A, it is based on the premise that the inside of the nozzle and the inside of the suction flow passage are to be cleaned. However, the cleaning of ink adhering to the outside of the nozzle and the like is not considered. That is, in a case where a distance between the print head and a medium to be printed is short in the ink jet recording apparatus, ink is splashed to the print head when colliding with the medium to be printed and the splashed ink are attracted to the deflecting electrodes provided in the print head since being charged with electricity. For this reason, there is a concern that the deflecting electrodes may be contaminated. Accordingly, there is a possibility that print quality may deteriorate in a case where the deflecting electrodes are left in this state.

Since floating ink is sucked by an electrostatic force in WO 2018/105714 A, the contamination of the inner and outer portions of the print head can be suppressed. However, since the suppression of the contamination is not perfect, some kind of cleaning is necessary.

Accordingly, when the ejection of ink from the nozzle is stopped in the ink jet recording apparatus, a worker handling the apparatus has cleaned main components, such as the nozzle and the deflecting electrodes provided in the print head, by using a cleaning bottle that stores a solvent (operation for cleaning a print head). However, this operation for cleaning a print head has a problem that working hours required for the operation for cleaning a print head or the degree of removal of ink dirt after the completion of the operation for cleaning a print head may vary according to the level of skill of a worker.

SUMMARY OF THE INVENTION

An object of the invention is to provide an ink jet recording apparatus that can perform a stable operation for cleaning a print head regardless of the level of skill of a worker.

The invention has been made in consideration of the related art and the problem, and an aspect of the invention provides an ink jet recording apparatus including: an ink container in which ink to be used to perform printing on a print target is stored; a nozzle which is connected to the ink container and from which pressurized and supplied ink is jetted; charging electrodes that charge ink particles jetted from the nozzle with electricity; deflecting electrodes that polarize the ink particles charged with electricity by the charging electrodes; a gutter that recovers ink not used for printing; a solvent container in which a solvent is stored; and a liquid nozzle which is connected to the solvent container and from which a pressurized and supplied solvent is jetted. The liquid nozzle includes a liquid flow passage portion that extends from the nozzle in a direction of the gutter, and a liquid jet hole that is formed at an angle allowing the pressurized and supplied solvent to hit the nozzle through the liquid flow passage portion.

According to the invention, it is possible to provide an ink jet recording apparatus that can perform a stable operation for cleaning a print head regardless of the level of skill of a worker.

DETAILED DESCRIPTION OF THE PREFERRED EMBODIMENTS

Embodiments will be described below with reference to the drawings.

First Embodiment

Figure 1:
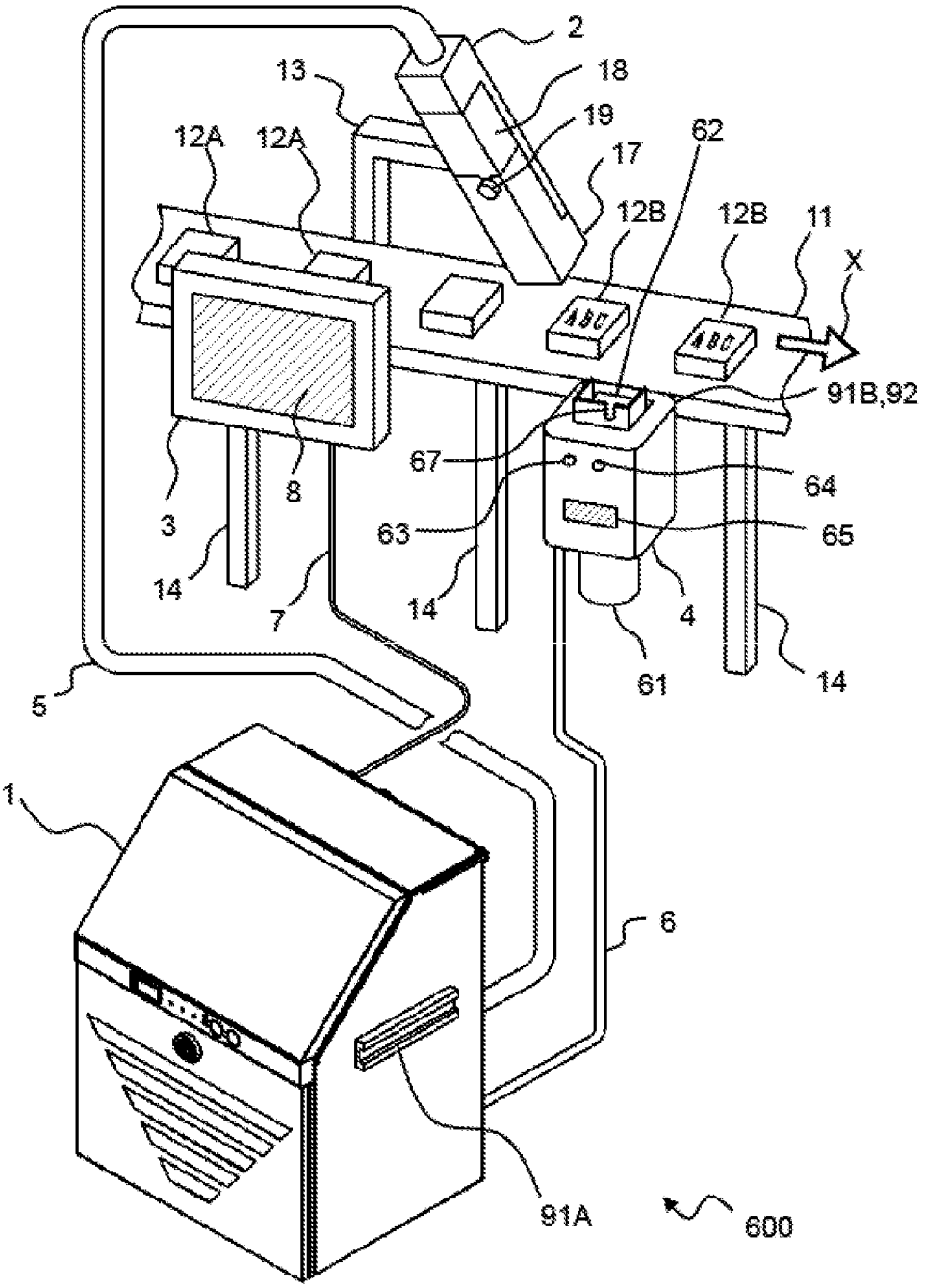
FIG. 1 is a perspective view illustrating a state where an ink jet recording apparatus according to a first embodiment is used.
Figure 2:
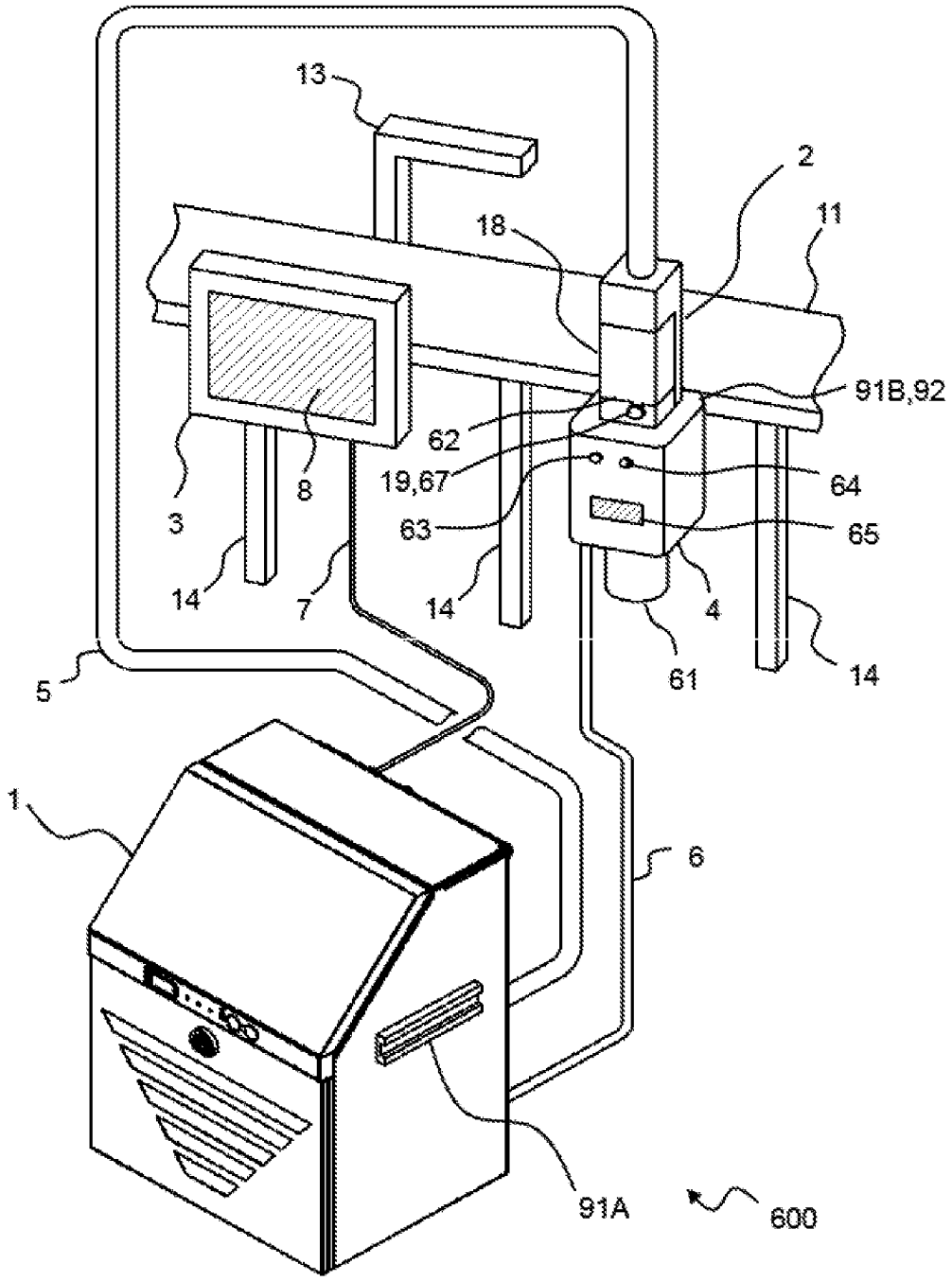
FIG. 2 is a perspective view illustrating a state where a print head is set on a cleaning unit in the ink jet recording apparatus according to the first embodiment.

A state where an ink jet recording apparatus 600 according to this embodiment is used will be described with reference to FIGS. 1 and 2. FIG. 1 is a perspective view illustrating a state where the ink jet recording apparatus 600 according to this embodiment is used, and FIG. 2 is a perspective view illustrating a state where a print head 2 is mounted on a head cleaning unit 4 in the ink jet recording apparatus 600 according to this embodiment.

First, as illustrated in FIG. 1, the ink jet recording apparatus 600 includes an ink jet recording apparatus body 1, a print head 2 that is connected to the ink jet recording apparatus body 1 through a conduit (for a print head) 5, a head cleaning unit 4 that is connected to the ink jet recording apparatus body 1 through a conduit (for a head cleaning unit) 6, and a separated panel 3 that is connected to the ink jet recording apparatus body 1 through a cable (for a separated panel) 7.

The ink jet recording apparatus 600 is installed on a production line in a factory where, for example, articles of food, beverages, or the like are produced, and the ink jet recording apparatus body 1 is installed at a place where a space required for regular maintenance work and the like can be ensured. The print head 2 is fixed to a print head-fixing bracket 13 installed near a belt conveyor 11, and is installed at a position where the print head 2 can be close to print targets 12A and 12B to be conveyed on the production line, such as the belt conveyor 11, in the direction of an arrow X.

The ink jet recording apparatus 600 is adapted to perform printing as follows. A control unit 9 (not illustrated) provided in the ink jet recording apparatus body 1 controls the amount of electricity to be applied to ink particles 59B to be jetted from a nozzle 21 assembled to the print head 2 and the timing when the ink particles are to be charged with electricity; and the ink particles 59B, which are charged with electricity and polarized, are attached to the print target (which is being printed) 15B while the print target (which is not yet printed) 15A passes near the print head 2. Further, a head cover 17 and a protective cover 18 are mounted on the print head 2 to protect components provided in the print head 2, and the head cover 17 can be attached and detached by a fixing knob 19.

The head cleaning unit 4 is installed near the print head 2, and a head cleaning unit-fixing jig A (for a conveyor) 91B assembled to the belt conveyor 11 and a head cleaning unit-fixing jig B 92 assembled to the head cleaning unit 4 are fitted to each other, so that the head cleaning unit 4 is fixed. Further, the head cleaning unit 4 includes a print head-insertion portion 62 that is used to insert the print head 2 into the head cleaning unit 4, and a print head-fixing part 67 that is used to fix the print head 2 to the head cleaning unit 4. Since the ink jet recording apparatus body 1 includes a head cleaning unit-fixing jig A (for a body) 91A that is used to fix the head cleaning unit 4, the ink jet recording apparatus 600 is adapted to be also used in a state where the head cleaning unit 4 is detached from the head cleaning unit-fixing jig A (for a conveyor) 91B and is attached to the head cleaning unit-fixing jig A (for a body) 91A.

Furthermore, the head cleaning unit 4 includes a start button 63 that is used to start cleaning processing for the print head 2, a stop button 64 that is used to stop the cleaning processing for the print head 2, and a display part that allows a worker to recognize alarms, such as a confirmation message, a warning, and an abnormality. Moreover, a cleaning liquid bottle 61, which stores cleaning liquid 69C having been used to clean the head, is assembled to the lower portion of the head cleaning unit 4.

Further, the separated panel 3 is installed near the print head 2 and the head cleaning unit 4 so as to be easily operated by a worker, and is fixed to the belt conveyor 11. Since the belt conveyor 11 is supported by fixing posts 14 so as to be installed at a position higher than a floor surface, the belt conveyor 11 is positioned at a height that is very suitable in a case where a user operates an operation display portion 8 of the separated panel 3 or mounts the head cleaning unit 4. The separated panel 3 and the head cleaning unit 4 are fixed to the belt conveyor 11 in this embodiment. However, in the ink jet recording apparatus 600 according to this embodiment, the separated panel 3 and the head cleaning unit 4 can be freely attached to a place that allows a user to easily operate the separated panel 3 and the head cleaning unit 4.

Next, a state where the print head 2 is set on the head cleaning unit 4 in the ink jet recording apparatus 600 will be described with reference to FIG. 2. The print head 2 is inserted into the print head-insertion portion 62 of the head cleaning unit 4 from the end of the print head 2 in a state where the head cover 17 is detached. Then, the print head-fixing part 67 and the fixing knob 19 are fitted to each other, so that the print head 2 is fixed to and mounted on the head cleaning unit 4. The print head 2 is set on the head cleaning unit 4 as described above, so that the ink jet recording apparatus 600 according to this embodiment can clean the print head 2.

Meanwhile, it is preferable that the length of the conduit (for a head cleaning unit) 6 connecting the head cleaning unit 4 to the ink jet recording apparatus body 1 is equal to or longer than the length of the conduit (for a print head) 5 connecting the print head 2 to the ink jet recording apparatus body 1. The reason for this is to ensure the degree of freedom in arranging the head cleaning unit 4.

Figure 3:
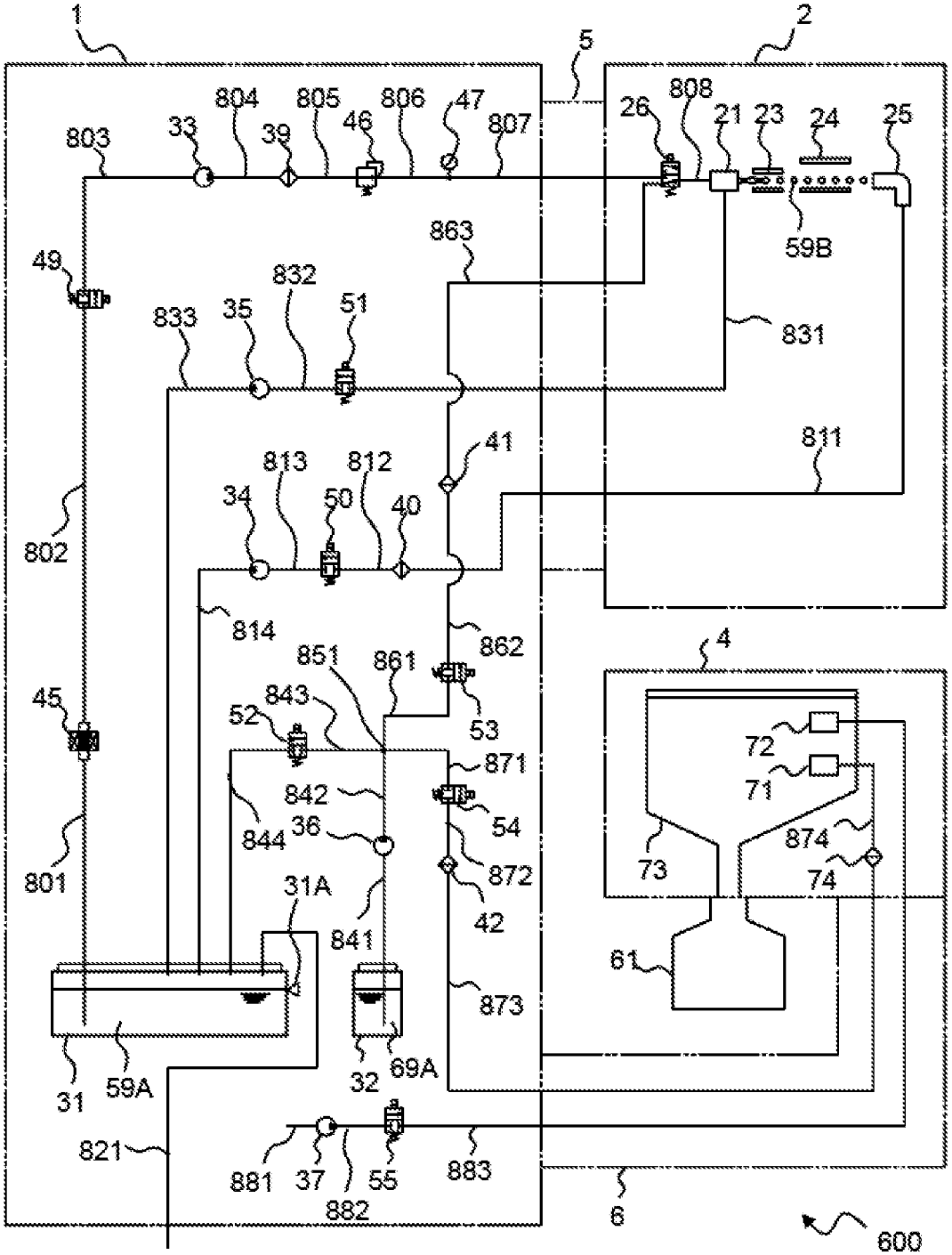
FIG. 3 is a diagram illustrating the passage configuration of the ink jet recording apparatus according to the first embodiment.

FIG. 3 is a diagram illustrating the passage configuration of the entire ink jet recording apparatus 600 according to this embodiment.

First, the ink supply passage of the ink jet recording apparatus 600 according to this embodiment will be described. In FIG. 3, the ink jet recording apparatus body 1 is provided with a main ink container 31 that stores ink 59A to circulate, and the main ink container 31 is provided with a liquid level sensor 31A that detects whether or not liquid stored in the main ink container 31 reaches a reference liquid level corresponding to the amount of liquid appropriate in a case where liquid is to be stored in the main ink container 31.

The main ink container 31 is connected to a viscometer 45 through a passage 801 to find out the viscosity of the ink 59A stored in the main ink container 31. The viscometer 45 is connected to a solenoid valve (for supply) 49, which opens and closes a passage, through a passage 802, and the solenoid valve (for supply) 49 is connected to a pump (for supply) 33, which is used to suck and pump the ink 59A, through a passage 803. Further, the pump (for supply) 33 is connected to a filter (for supply) 39, which removes foreign materials mixed in the ink 59A, through a passage 804.

The filter (for supply) 39 is connected to a pressure regulating valve 46, which regulates the pressure of the ink 59A pumped from the pump (for supply) 33 to proper pressure, through a passage 805, and the pressure regulating valve 46 is connected to a pressure sensor 47, which measures the pressure of the ink 59A to be supplied to the nozzle 21, through a passage 806. The pressure sensor 47 is connected to a switching valve 26, which is provided in the print head 2 and is used to control whether or not to supply the ink 59A to the nozzle 21, through a passage 807 passing through the conduit (for a print head) 5.

The switching valve 26 is connected to the nozzle 21, which includes an outlet through which the ink 59A is to be jetted, through a passage 808. Meanwhile, since the switching valve 26 is a three-way solenoid valve and the passage 807 for the supply of ink and a cleaning passage 863 are connected to the switching valve 26, the switching valve 26 can switch the supply of ink and a solvent to the nozzle 21. Charging electrodes 23 that are used to apply a predetermined quantity of electric charge to the ink particles 59B, deflecting electrodes 24 that are used to polarized ink particles 59B to be used for printing, and a gutter 25 that is used to capture ink particles 59B flying straight without being charged with electricity and being polarized since being not used for printing, are arranged in the straight direction of the outlet of the nozzle 21.

Next, the ink recovery passage of the ink jet recording apparatus 600 according to this embodiment will be described.

In FIG. 3, the gutter 25 is connected to a filter (for recovery) 40, which is disposed in the ink jet recording apparatus body 1 and removes foreign materials mixed in the ink, through a passage 811 passing through the conduit (for a print head) 5, and the filter (for recovery) 40 is connected to a solenoid valve (for recovery) 50, which opens and closes a passage, through a passage 812.

The solenoid valve (for recovery) 50 is connected to a pump (for recovery) 34, which sucks the ink particles 59B captured by the gutter 25, through a passage 813. The pump (for recovery) 34 is connected to the main ink container 31 through a passage 814. Further, the main ink container 31 is connected to an exhaust passage 821, and the exhaust passage 821 is adapted to communicate with the outside of the ink jet recording apparatus body 1.

Next, the ink circulation passage of the ink jet recording apparatus 600 according to this embodiment will be described. The nozzle 21 provided in the print head 2 is connected to a solenoid valve (for circulation) 51, which is provided in the ink jet recording apparatus body 1 and opens and closes a flow passage, through a passage 831 passing through the conduit (for a print head) 5 other than the passage 808 for the supply of ink. The solenoid valve (for circulation) 51 is connected to a pump (for circulation) 35, which sucks ink jetted from the nozzle 21, through a passage 832. Further, the pump (for circulation) 35 is adapted to be connected to the main ink container 31 through a passage 833.

Next, the solvent supply passage of the ink jet recording apparatus 600 according to this embodiment will be described. In FIG. 3, the ink jet recording apparatus body 1 is provided with a solvent container 32 that stores a solvent 69A to be used for the supply of solvent to the main ink container 31, the cleaning of the nozzle, or the cleaning of the head, and the solvent container 32 is connected to a pump (for solvent) 36, which is used to suck and pump the solvent, through a passage 841. The pump (for solvent) 36 is connected to a branch passage 851 through a passage 842 to change the supply destination of the solvent 69A according to the purpose. The branch passage 851 is connected to a solenoid valve (for the supply of solvent) 52 through a passage 843 on the solvent supply passage to open and close a flow passage, and the solenoid valve (for the supply of solvent) 52 is connected to the main ink container 31 through a passage 844.

Next, the nozzle cleaning passage of the ink jet recording apparatus 600 according to this embodiment will be described. In FIG. 3, the pump (for solvent) 36 is connected to a solenoid valve (for the cleaning of a nozzle) 53, which is used to open and close a flow passage, through a passage 861 and the branch passage 851 provided on the passage 842. Further, the solenoid valve (for the cleaning of a nozzle) 53 is connected to a filter (for the cleaning of a nozzle) 41, which removes foreign materials mixed in the solvent 69A, through a passage 862, and the filter (for the cleaning of a nozzle) 41 is adapted to be connected to the switching valve 26, which is provided in the print head 2 and is used to control whether or not to send the solvent 69A to be used for cleaning to the nozzle 21, through a passage 863.

Next, the head cleaning passage of the ink jet recording apparatus 600 according to this embodiment will be described. In FIG. 3, the pump (for solvent) 36 is connected to a solenoid valve (for the cleaning of a head) 54, which is used to open and close a flow passage, through a passage 871 and the branch passage 851 provided on the passage 842. Further, the solenoid valve (for the cleaning of a head) 54 is connected to a filter (for the cleaning of a head) 42, which removes foreign materials mixed in the solvent 69A, through a passage 872, and the filter (for the cleaning of a head) 42 is connected to a final filter (for the cleaning of a head) 74, which is provided in the head cleaning unit 4 and is used to remove foreign materials initially mixed in a passage 873, through the passage 873 passing through the conduit (for a head cleaning unit) 6. Furthermore, the final filter (for the cleaning of a head) 74 is connected to a head cleaning nozzle 71, which is provided in a head cleaning tank 73 of the head cleaning unit 4, through a passage 874. Here, a space in the head cleaning tank 73 is adapted to communicate with the cleaning liquid bottle 61 that is installed on the lower portion of the head cleaning tank 73.

Next, the head drying passage of the ink jet recording apparatus 600 according to this embodiment will be described. In FIG. 3, the ink jet recording apparatus body 1 is provided with a pump (for the supply of dry air) 37 that is used to suck and pump air, a passage 881 where an air suction port communicating with the inside of the ink jet recording apparatus body 1 is formed is connected to the pump (for the supply of dry air) 37, and the pump (for the supply of dry air) 37 is connected to a solenoid valve (for the supply of dry air) 55, which is used to open and close a flow passage, through a passage 882. Further, the solenoid valve (for the supply of dry air) 55 is adapted to be connected to a head-drying air nozzle 72, which is provided in the head cleaning tank 73 of the head cleaning unit 4, through a passage 883 passing through the conduit (for a head cleaning unit) 6.

Figure 4A:
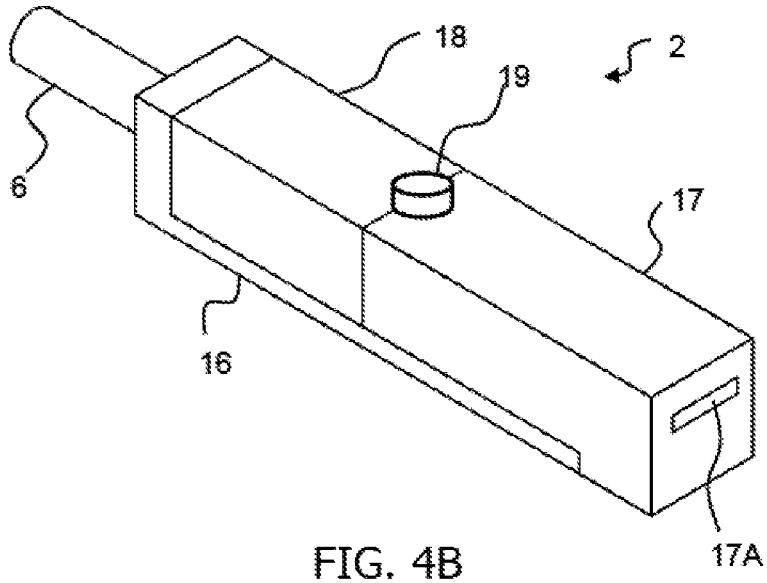
FIGS. 4A and 4B are perspective views illustrating the appearance of the print head of the first embodiment.
Figure 4B:
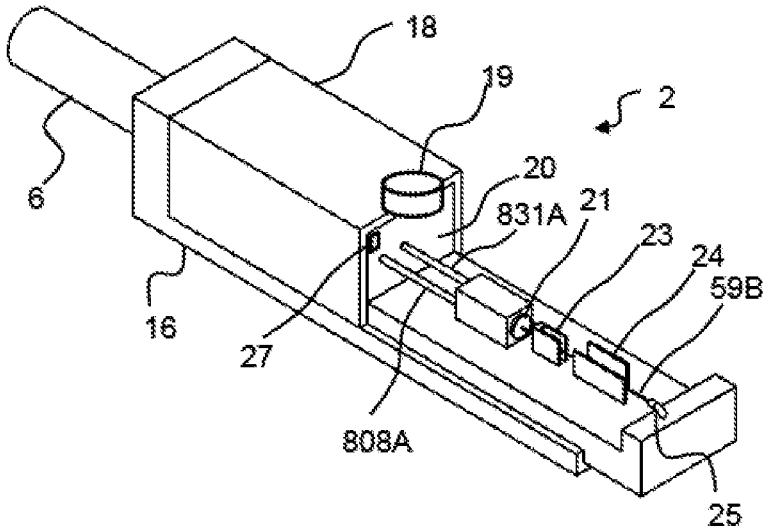

Next, the structure of the print head 2 of the ink jet recording apparatus 600 according to this embodiment will be described with reference to FIGS. 4A and 4B. FIGS. 4A and 4B are perspective views illustrating the appearance of the print head of this embodiment. FIG. 4A is a perspective view illustrating the appearance of the print head 2, and FIG. 4B is a perspective view of the print head 2 in a state where the head cover 17 is removed.

In FIG. 4A, the print head 2 includes a head base 16, the conduit (for a head cleaning unit) 6 that connects the print head 2 to the ink jet recording apparatus body 1, the protective cover 18 that is assembled to protect the switching valve 26 (not illustrated) installed on the head base 16, and the head cover 17 at which a print opening 17A through which ink particles to be used for printing are to pass is formed and which is assembled to the protective cover 18 by the fixing knob 19. In a state where the head cover 17 is assembled, a space surrounded by the head base 16 and the head cover 17 is protected from an impact to be generated at the time of maintenance, and the like. The space surrounded by the head base 16 and the head cover 17 is a space where a worker working daily performs the maintenance of components surrounded by the head cover 17, and an internal area surrounded by the head base 16 and the protective cover 18 is an area where a so-called service technician performs maintenance.

Next, in the print head 2 in a state of FIG. 4B where the head cover 17 is detached, the nozzle 21 that is used to jet ink particles 59B, the charging electrodes 23 that are disposed in parallel and symmetrically with respect to the ink particles 59B jetted from the nozzle 21, and a set of two deflecting electrodes 24 that is disposed on the secondary side of the charging electrodes 23 in the direction of flight of the ink particles 59B are placed and mounted on the head base 16. The gutter 25, which is disposed on the secondary side of the deflecting electrodes 24 in the direction of flight of the ink particles 59B and at which a hole used to capture ink particles 59B not used for printing is formed on the central axis of the flight of the ink particles 59B, is further mounted on the head base 16. A tube (for supply) 808A and a tube (for circulation) 831A, which are made of PTFE having solvent resistance, are connected to the nozzle 21.

Further, a partition member 20 is assembled to the print head 2 between the head base 16 and the protective cover 18 so that the inside of the protective cover 18 is not exposed to the outside even in a state where the head cover 17 is detached. Furthermore, a temperature sensor 27, which is used to detect temperature around the print head 2, is assembled to the partition member 20 of the print head 2. The temperature sensor 27 is utilized for the control of printing of the ink jet recording apparatus 600 and the control of a head cleaning time.

Figure 5:
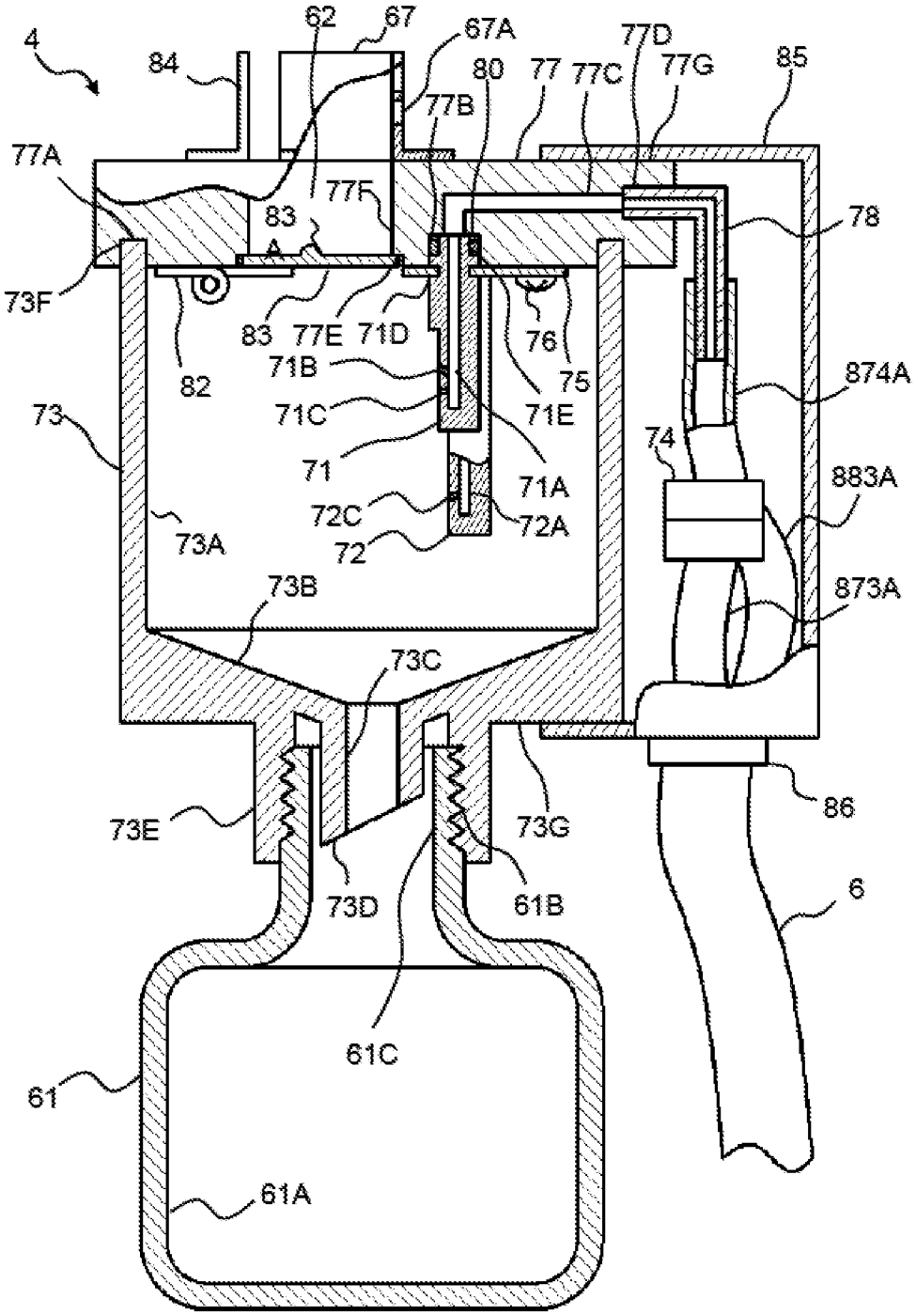
FIG. 5 is a diagram illustrating the structure of a head cleaning unit in which a head cleaning nozzle of the first embodiment is illustrated as a cross-section.
Figure 6:
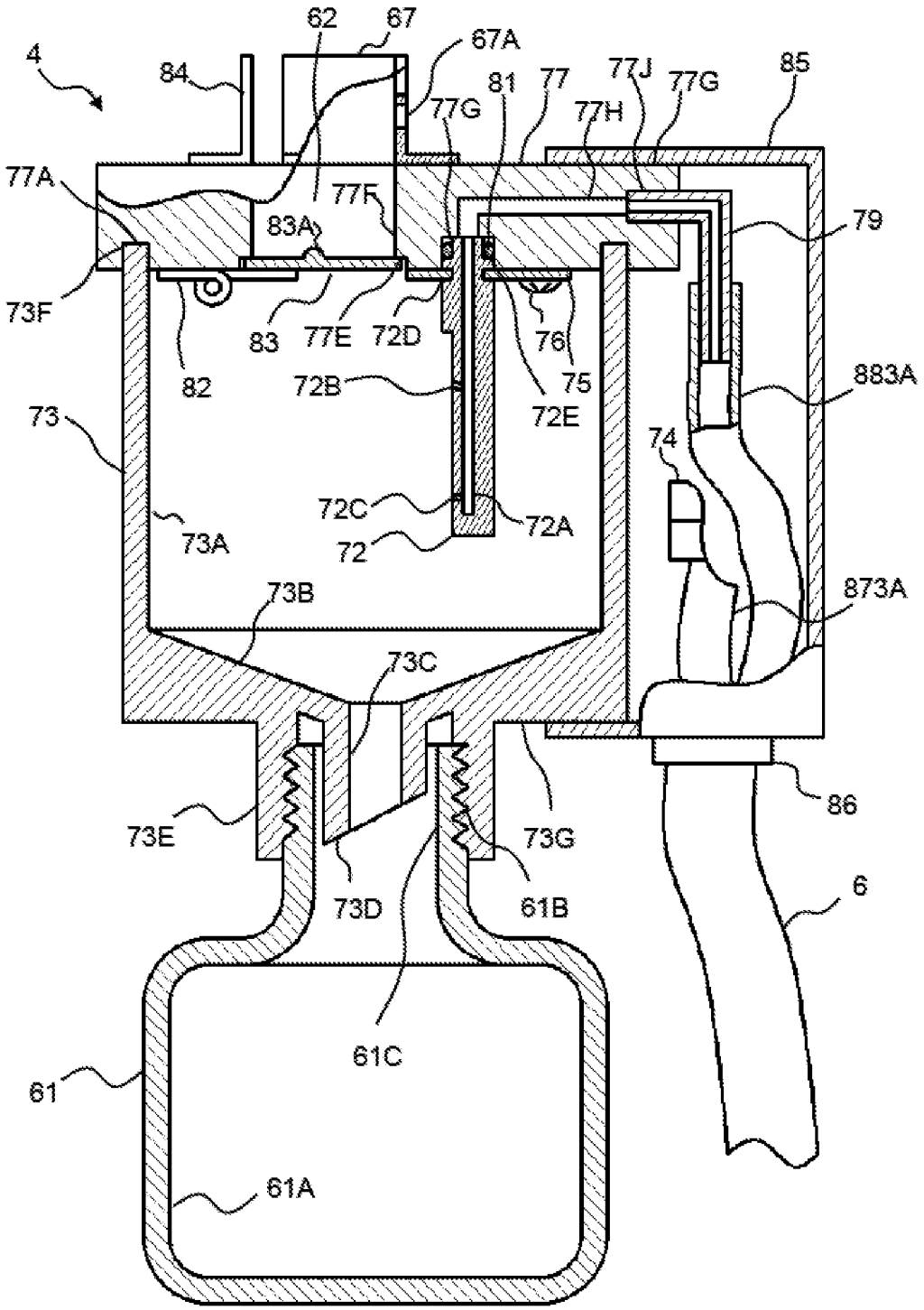
FIG. 6 is a diagram illustrating the structure of the head cleaning unit in which a head-drying air nozzle of the first embodiment is illustrated as a cross-section.
Figure 7:
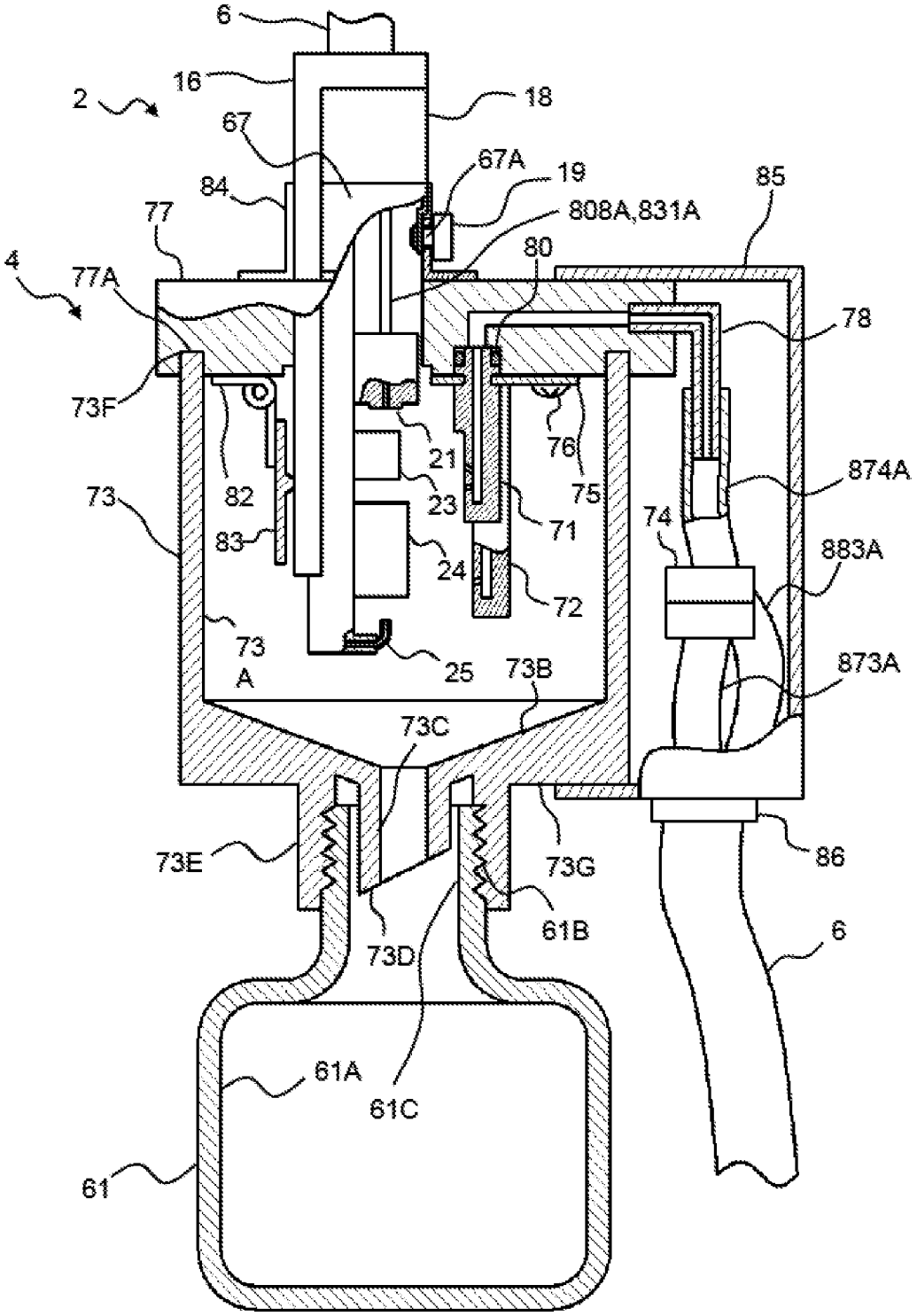
FIG. 7 is a cross-sectional view of the head cleaning unit in a state where the print head is set on the head cleaning unit of the first embodiment.
Figure 8:
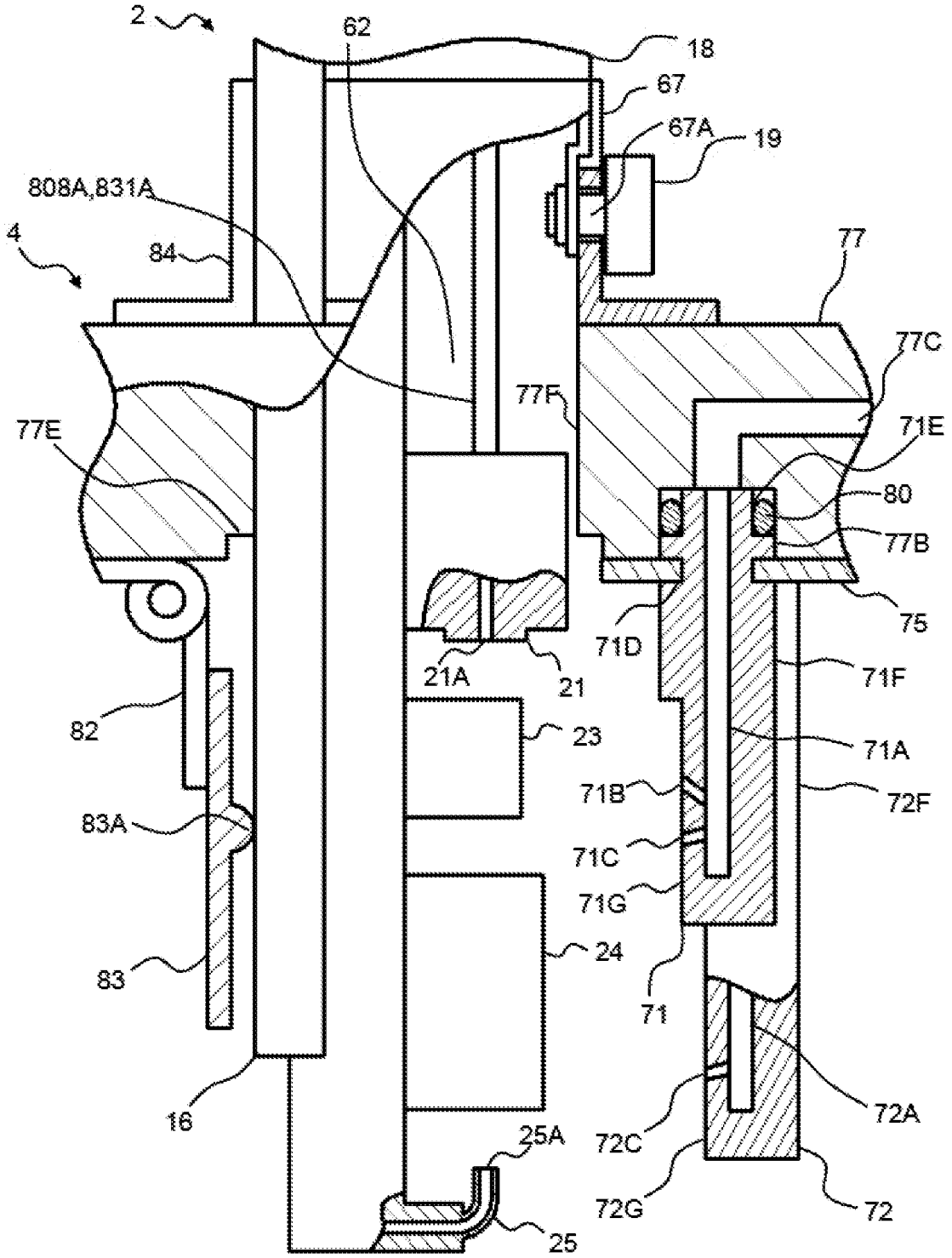
FIG. 8 is an enlarged view illustrating the print head and the cleaning nozzle of FIG. 7 and the structure therearound.

Next, the structure of the head cleaning unit 4 of the ink jet recording apparatus 600 according to this embodiment will be described with reference to FIGS. 5, 6, 7, and 8. FIG. 5 is a diagram illustrating the structure of the head cleaning unit in which the head cleaning nozzle 71 of this embodiment is illustrated as a cross-section, and FIG. 6 is a diagram illustrating the structure of the head cleaning unit in which the head-drying air nozzle 72 of this embodiment is illustrated as a cross-section. Further, FIG. 7 is a cross-sectional view of the head cleaning unit 4 in a state where the print head 2 is set on the head cleaning unit 4 of this embodiment. FIG. 8 is an enlarged view illustrating the print head 2 and the head cleaning nozzle 71 of FIG. 7 and the structure therearound.

In FIGS. 5, 6, 7, and 8, the head cleaning unit 4 includes the head cleaning tank 73 in which the print head 2 is to be received during the cleaning of the head, and a cleaning lid block 77 which is installed on the upper portion of the head cleaning tank 73 and in which the print head-insertion portion 62 used to set the print head 2 on the head cleaning unit 4 is formed.

A lid member 83, which closes the opening of the print head-insertion portion 62, is assembled to the cleaning lid block 77 to prevent foreign materials, such as dust, from entering the head cleaning tank 73 in a case where the print head 2 is not set. The lid member 83 is assembled to the cleaning lid block 77 through a lid hinge 82. A lid member protrusion 83A is formed on the lid member 83 to reduce friction resistance that is generated when the print head 2 is inserted into the head cleaning unit 4. Further, a lid member-fitting recess 77E, to which the lid member 83 is exactly fitted, is formed on the cleaning lid block 77 to improve sealability in the head cleaning unit 4 in a case where the print head 2 is not set. Further, a print head-insertion hole 77F, which is an opening slightly larger than an insertion portion of the print head 2 to be inserted into the head cleaning unit 4, is formed in the cleaning lid block 77. The print head-insertion hole 77F formed in the cleaning lid block 77, the lid member 83, and the like form the print head-insertion portion 62 as described above.

Further, the print head-fixing part 67 that allows the position of the print head 2 to be stable during the cleaning of the head and a print head-guide part 84 that allows the print head 2 to be smoothly inserted during the insertion of the print head 2 into the head cleaning unit 4 are assembled to the cleaning lid block 77. Since a fixing knob-fitting portion 67A is formed at the print head-fixing part 67 and the print head 2 is fixed to the head cleaning unit 4 through the fixing knob-fitting portion 67A, the stability of the cleaning of the head can be ensured.

Furthermore, the head cleaning nozzle 71 that is used to eject a solvent 69B for the cleaning of the head to the print head 2 and the head-drying air nozzle 72 that is used to blow drying air for drying the print head 2 wetted with the solvent 69B after the cleaning of the head are assembled to the cleaning lid block 77 by a nozzle-fixing plate 75 and a nozzle-fixing screw 76. Since a liquid nozzle-fixing groove 71D is formed on the head cleaning nozzle 71 and the nozzle-fixing plate 75 is adapted to be fitted to the liquid nozzle-fixing groove 71D, the head cleaning nozzle 71 is adapted to be easily assembled. Further, since an air nozzle-fixing groove 72D is formed on the head-drying air nozzle 72 and the nozzle-fixing plate 75 is adapted to be fitted to the air nozzle-fixing groove 72D likewise, the head-drying air nozzle 72 is adapted to be easily assembled.

The head cleaning nozzle 71 includes a liquid nozzle-outer portion 71F that is formed in a columnar shape, and a liquid nozzle-flow passage portion 71A that is formed in the head cleaning nozzle 71 so as to extend from the nozzle 21 in the direction of the gutter 25 in a case where the print head 2 is set on the head cleaning unit 4. In addition, the head cleaning nozzle 71 includes a liquid nozzle-ejection hole A portion 71B, a liquid nozzle-ejection hole B portion 71C, a liquid nozzle-ejection hole C portion 71H (not illustrated), and a liquid nozzle-planar portion 71G. The liquid nozzle-ejection hole A portion 71B is formed at an angle allowing the solvent 69B to aim at the nozzle 21, that is, allowing the solvent 69B to hit the nozzle 21 through the liquid nozzle-flow passage portion 71A, and is used to eject the solvent 69B. The liquid nozzle-ejection hole B portion 71C is formed at an angle allowing the solvent 69B to aim at the deflecting electrodes 24, that is, allowing the solvent 69B to hit the deflecting electrodes 24 through the liquid nozzle-flow passage portion 71A, and is used to eject the solvent 69B. The liquid nozzle-ejection hole C portion 71H is formed at an angle allowing the solvent 69B to aim at the charging electrodes 23, that is, allowing the solvent 69B to hit the charging electrodes 23 through the liquid nozzle-flow passage portion 71A, and is used to eject the solvent 69B. The liquid nozzle-planar portion 71G is manufactured by forming a part of the liquid nozzle-outer portion 71F in a planar shape so that the liquid nozzle-ejection hole A portion 71B, the liquid nozzle-ejection hole B portion 71C, and the liquid nozzle-ejection hole C portion 71H (not illustrated) are easily formed.

As described above, the liquid nozzle-flow passage portion 71A is disposed on one side of the nozzle 21, the charging electrodes 23, and the deflecting electrodes 24 opposite to the head base 16 and serves as the supply passage of the solvent 69B to the liquid nozzle-ejection holes that eject the solvent 69B to the nozzle 21, the charging electrodes 23, and the deflecting electrodes 24, respectively.

A liquid nozzle-sealing portion 71E of which the surface roughness is reduced is formed on the head cleaning nozzle 71; and the liquid nozzle-sealing portion 71E is assembled to a cleaning lid-liquid nozzle mounting portion 77B, which is formed at the cleaning lid block 77, together with a liquid sealing member 80 to prevent the leakage of the solvent 69B. Here, the liquid nozzle-flow passage portion 71A formed in the head cleaning nozzle 71 is adapted to be connected to a cleaning lid-liquid flow passage 77C formed in the cleaning lid block 77.

Further, the head-drying air nozzle 72 includes an air nozzle-outer portion 72F, an air nozzle-flow passage portion 72A, an air nozzle-ejection hole A portion 72B, an air nozzle-ejection hole B portion 72C, and an air nozzle-planar portion 72G. The air nozzle-outer portion 72F is formed in a columnar shape. The air nozzle-flow passage portion 72A is formed in the head-drying air nozzle 72 so as to extend from the nozzle 21 in the direction of the gutter 25 in a case where the print head 2 is set on the head cleaning unit 4. The air nozzle-ejection hole A portion 72B is connected to the air nozzle-flow passage portion 72A and is used to eject air to allow air to aim at a space between the charging electrodes 23. The air nozzle-ejection hole B portion 72C is connected to the air nozzle-flow passage portion 72A and is used to eject air to allow air to aim at a space between the charging electrodes 23. The air nozzle-planar portion 72G is manufactured by forming a part of the air nozzle-outer portion 72F in a planar shape so that the air nozzle-ejection hole A portion 72B and the air nozzle-ejection hole B portion 72C are easily formed.

As described above, the air nozzle-flow passage portion 72A is disposed on one side of the nozzle 21, the charging electrodes 23, and the deflecting electrodes 24 opposite to the head base 16 and serves as the supply passage of air to the air nozzle-ejection holes that eject air to the nozzle 21, the charging electrodes 23, and the deflecting electrodes 24, respectively.

An air nozzle-sealing portion 72E of which the surface roughness is reduced is formed on the head-drying air nozzle 72; and the air nozzle-sealing portion 72E is assembled to a cleaning lid-air nozzle mounting portion 77G, which is formed at the cleaning lid block 77, together with an air sealing member 81 to prevent the leakage of air. Here, the air nozzle-flow passage portion 72A formed in the head-drying air nozzle 72 is adapted to be connected to a cleaning lid-air flow passage 77H formed in the cleaning lid block 77.

Further, the head cleaning unit 4 includes the head cleaning tank 73 that is provided under the cleaning lid block 77 and is used to receive the print head 2 during the cleaning of the head. The head cleaning tank 73 includes a cleaning tank-side wall portion 73A that is formed to prevent the solvent 69B ejected from the head cleaning nozzle 71 from being scattered around the head cleaning tank 73, and a cleaning tank-upper end portion 73F that is formed at the upper portion of the cleaning tank-side wall portion 73A. The cleaning tank-upper end portion 73F is fitted to a cleaning lid-mounting groove 77A formed on the lower portion of the cleaning lid block 77, so that the head cleaning tank 73 is fixed to the cleaning lid block 77 and is sealed.

Furthermore, the head cleaning tank 73 includes a cleaning tank-liquid outflow pipe 73C and a cleaning tank-conical inner bottom 73B therein. The cleaning tank-liquid outflow pipe 73C allows the solvent 69B, which is jetted from the head cleaning nozzle 71, to flow out of the head cleaning tank 73. The cleaning tank-conical inner bottom 73B is formed obliquely so that the cleaning tank-liquid outflow pipe 73C is positioned at the lowest position to allow the solvent 69B to be easily collected at the cleaning tank-liquid outflow pipe 73C.

Further, the cleaning lid block 77 includes a cleaning lid-liquid joint mounting portion 77D that is connected to the cleaning lid-liquid flow passage 77C, and a liquid joint 78 is connected to the cleaning lid-liquid joint mounting portion 77D. Furthermore, a tube (for cleaning) 874A, which is made of a fluorine-based material having solvent resistance, is connected to the liquid joint 78 by a method, such as press-fitting, and the tube (for cleaning) 874A is mounted on the final filter (for the cleaning of a head) 74 that is used to remove foreign materials mixed in the solvent 69A to be supplied to the head cleaning nozzle 71. Moreover, a tube (for cleaning) 873A, which is made of a fluorine-based material having solvent resistance, is connected to the final filter (for the cleaning of a head) 74, and the tube (for the cleaning of a head) 873A is connected to a filter (for the cleaning of a head) 44 that is disposed in the ink jet recording apparatus body 1 through the conduit (for a head cleaning unit) 6.

Further, the cleaning lid block 77 includes a cleaning lid-air joint mounting portion 77J that is connected to the cleaning lid-air flow passage 77H, and an air joint 79 is connected to the cleaning lid-air joint mounting portion 77J. Furthermore, a tube (for the supply of air) 883A, which is made of a fluorine-based material having solvent resistance, is connected to the air joint 79 by a method, such as press-fitting. Moreover, the tube (for the supply of air) 883A is connected to the solenoid valve (for the supply of dry air) 55 that is disposed in the ink jet recording apparatus body 1 through the conduit (for a head cleaning unit) 6.

Further, the head cleaning unit 4 includes a cleaning tank cover 85 so that the tubes (for cleaning) 873A and 874A and the tube (for the supply of air) 883A are not exposed to the outside of the head cleaning unit 4. The cleaning tank cover 85 is fixed to a cleaning lid-upper outer portion 77K that is formed at the upper portion of the cleaning lid block 77 and a cleaning tank-lower outer portion 73G that is formed at the lower portion of the head cleaning tank. The conduit (for a head cleaning unit) 6 is assembled to the lower portion of the cleaning tank cover 85 by a conduit fixing nut 86 so that the conduit (for a head cleaning unit) 6 does not protrude outward and does not obstruct other production facilities.

Furthermore, the head cleaning tank 73 includes a cleaning tank-bottle mounting portion 73E that is formed in a cylindrical shape at the lower portion of the head cleaning tank 73, and the cleaning tank-liquid outflow pipe 73C that is formed inside the cleaning tank-bottle mounting portion 73E and is connected to the inside of the head cleaning tank 73. Moreover, a cleaning tank-liquid outflow-inclined end portion 73D is formed at the lower end portion of the cleaning tank-liquid outflow pipe 73C so that the solvent 69B to drop down is likely to be concentrated on one position.

The detachable cleaning liquid bottle 61 can be set on the lower portion of the head cleaning unit 4. The cleaning liquid bottle 61 includes a bottle-liquid storage portion 61A that stores the cleaning liquid 69C having been used for head cleaning processing, a bottle mounting portion 61B to which the cleaning tank-bottle mounting portion 73E of the head cleaning tank 73 is to fitted and fixed, and a bottle-liquid inlet 61C that is formed to surround the cleaning tank-liquid outflow pipe 73C from the outside.

Next, structure in a state where the print head 2 is set on the head cleaning unit 4 of the ink jet recording apparatus 600 according to this embodiment will be described. In FIGS. 7 and 8, the print head 2 is set on the head cleaning unit 4 in a state where the head cover 17 is removed. The print head 2 is inserted up to a position where the nozzle 21, the charging electrodes 23, the deflecting electrodes 24, and the gutter 25 are positioned in the head cleaning tank 73. Further, the head cleaning unit 4 is disposed at a position where the surface of the print head-guide part 84 and the surface of the head base 16 are parallel to each other and are close to each other a range where the slide of the print head 2 in the vertical direction is not obstructed so that the position of the head cleaning unit 4 relative to the print head 2 is not shifted. Furthermore, the print head-fixing part 67 of the head cleaning unit 4 is originally disposed to be fitted to a position on the print head 2 where the head cover 17 is mounted, and the protective cover 18 of the print head 2 and the fixing knob-fitting portion 67A formed at the print head-fixing part 67 are fixed to each other by the fixing knob 19, so that the print head 2 can be stably set on the head cleaning unit 4.

Figure 9:
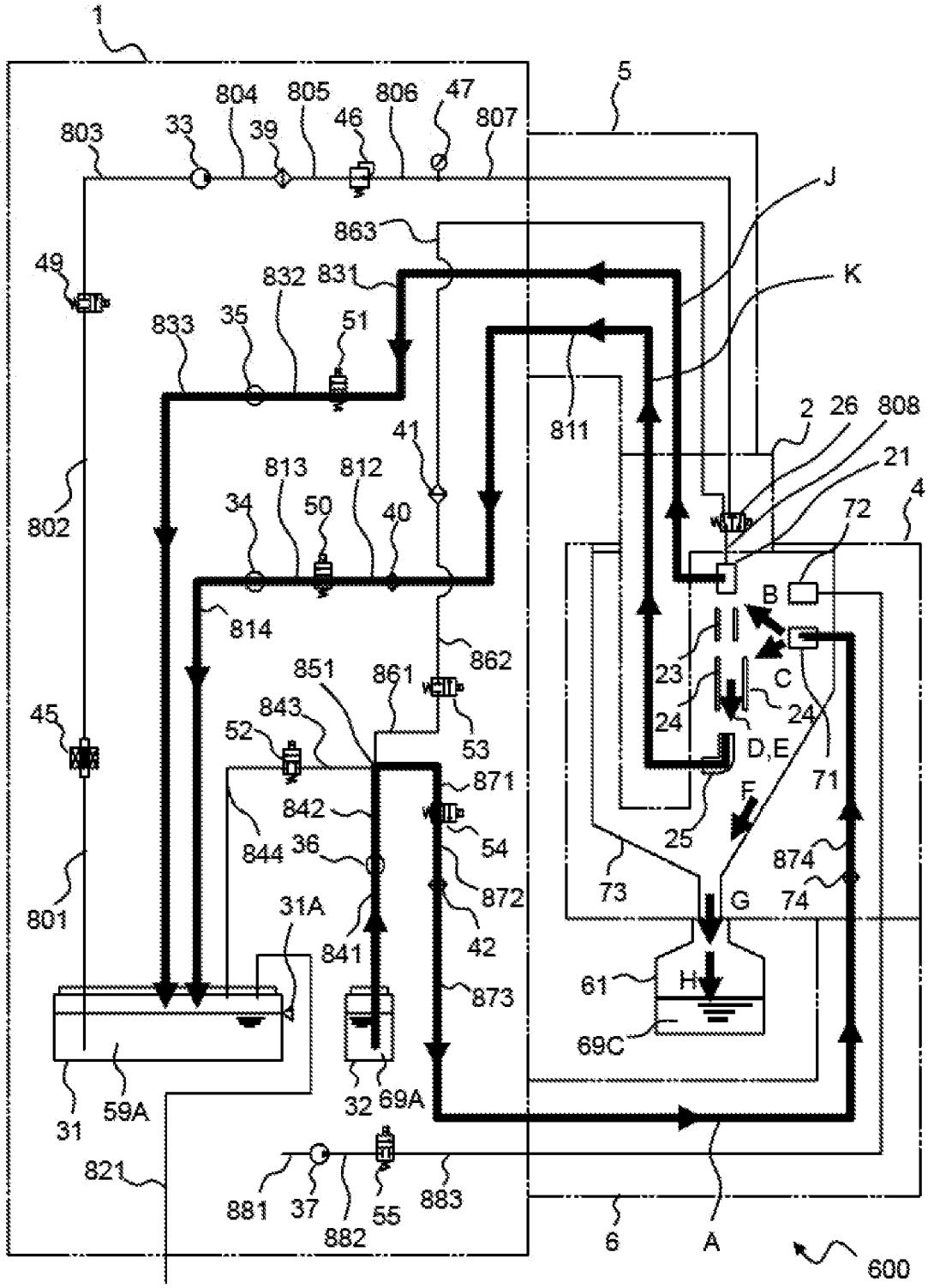
FIG. 9 is a diagram illustrating the passage configuration of the ink jet recording apparatus in a state where the print head is set on the head cleaning unit of the first embodiment.
Figure 10:
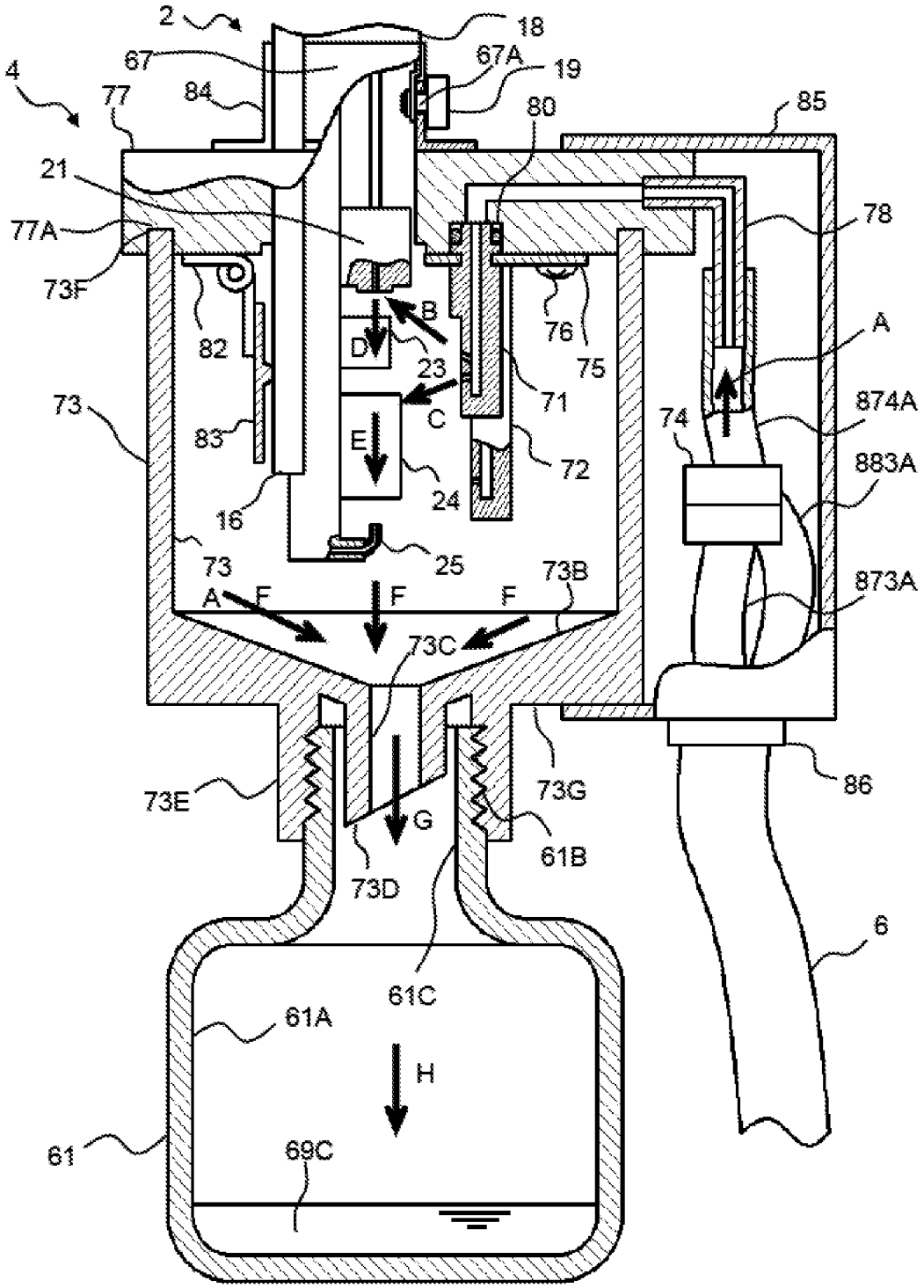
FIG. 10 is a cross-sectional view of the head cleaning unit illustrating the flow of liquid in the head cleaning unit when head cleaning processing of the first embodiment is performed.

Next, the operation of the ink jet recording apparatus 600 according to this embodiment when head cleaning processing is performed in a state where the print head 2 is set on the head cleaning unit 4 will be described with reference to FIGS. 9 to 11. FIG. 9 is a diagram illustrating the passage configuration of the ink jet recording apparatus 600 in a state where the print head 2 is set on the head cleaning unit 4 of this embodiment. The flows of the solvents 69A and 69B and the cleaning liquid 69C when the cleaning of the head of this embodiment and cleaning in the nozzle and a gutter passage are performed are shown in FIG. 9 by thick lines. FIG. 10 is a cross-sectional view of the head cleaning unit 4 illustrating the flow of liquid in the head cleaning unit 4 when head cleaning processing of this embodiment is performed, and FIG. 11 is an enlarged view illustrating the print head 2 and the head cleaning nozzle 71 when the head cleaning processing of the first embodiment is performed, and the structure therearound.

Figure 11:
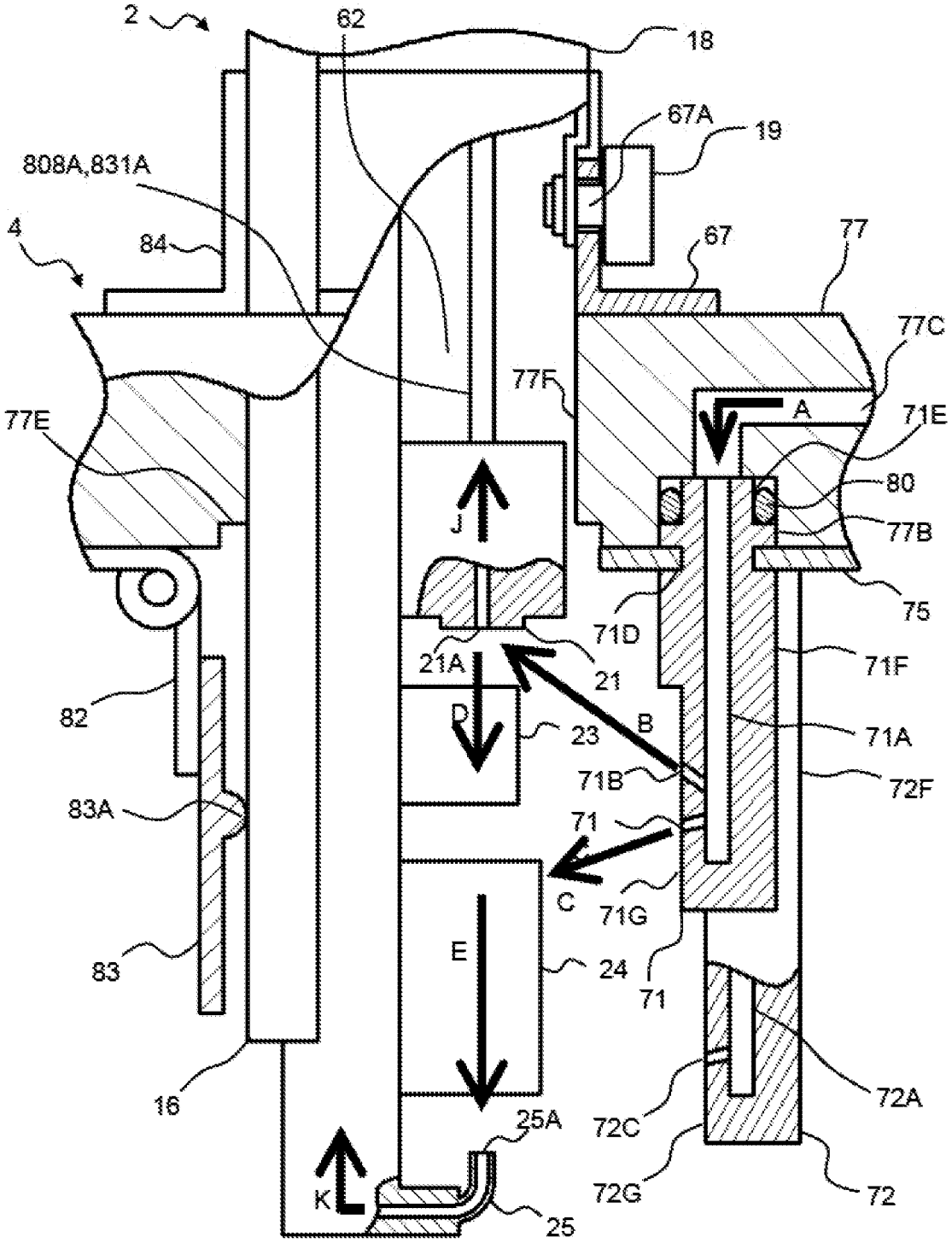
FIG. 11 is an enlarged view illustrating the print head and the cleaning nozzle when the head cleaning processing of the first embodiment is performed, and the structure therearound.

In FIGS. 9 to 11, the ink jet recording apparatus 600 ejects the solvent 69B from the head cleaning nozzle 71 in the head cleaning processing to perform the cleaning of the print head 2. In a state where the solvent 69B is being ejected from the head cleaning nozzle 71 in the head cleaning processing, the pump (for solvent) 36 is operated and electric current is applied to the solenoid valve (for the cleaning of a head) 54 so that the solenoid valve (for the cleaning of a head) 54 opens the flow passage. Accordingly, the solvent 69A stored in the solvent container 32 is supplied to the head cleaning nozzle 71 in a flow direction in which the solvent 69A is supplied as illustrated by an arrow A. Here, foreign materials initially mixed in the solvent 69A stored in the solvent container 32 are removed by the filter (for the cleaning of a head) 42. Further, since foreign materials, which are initially mixed between the filter (for the cleaning of a head) 42 and the final filter (for the cleaning of a head) 74, are removed by the final filter (for the cleaning of a head) 74, foreign materials are prevented from flowing into the head cleaning nozzle 71 together with the solvent 69A. Here, the replacement cycle of the filter (for the cleaning of a head) 42 is set to be shorter than the replacement cycle of the final filter (for the cleaning of a head) 74, and the installation position of the filter (for the cleaning of a head) 42 is provided at a place where the filter can be more easily replaced than at the installation position of the final filter (for the cleaning of a head) 74.

The solvent 69A supplied to the head cleaning nozzle 71 is ejected as the solvent 69B in the direction illustrated by an arrow B (a direction where the solvent 69B is ejected to the nozzle 21 from the liquid nozzle-ejection hole A portion 71B) and the direction illustrated by an arrow C (a direction where the solvent 69B is ejected to the deflecting electrodes 24 from the liquid nozzle-ejection hole B portion 71C), and the solvent 69B is sprayed on components assembled to the print head 2, such as the nozzle 21, the charging electrodes 23, and the deflecting electrodes 24. Accordingly, dirt, which is caused by the ink 59A adhering during the operation of the ink jet recording apparatus 600 and at the time of maintenance, can be cleaned. Further, since the solvent 69B, which is sprayed on the assembled components, such as the nozzle 21, the charging electrodes 23, and the deflecting electrodes 24, drops and flows in the directions illustrated by arrow D and E due to gravity, the gutter 25, which is disposed below the deflecting electrodes 24 in a state where the print head 2 is set on the head cleaning unit 4, can be cleaned with the solvent 69B.

Further, the solvent 69B having cleaned the components arranged on the print head 2, such as the nozzle 21, the charging electrodes 23, the deflecting electrodes 24, and the gutter 25, in the head cleaning processing drops down in the directions illustrated by arrows F, G, and H, flows into the cleaning liquid bottle 61 installed on the lower portion of the head cleaning unit 4, and is stored in the lower portion of the cleaning liquid bottle 61 as the cleaning liquid 69C.

Furthermore, in a state where the head cleaning processing of the ink jet recording apparatus 600 is being performed, the pump (for circulation) 35 is operated and electric current is applied to the solenoid valve (for circulation) 51 so that the solenoid valve (for circulation) 51 opens the flow passage. Accordingly, a part of the solvent 69B ejected from the head cleaning nozzle 71 in the direction of the arrow B is sucked from a nozzle outlet 21A, which is formed at the nozzle 21, and is recovered to the main ink container 31 in a flow direction in which the solvent 69B is sucked as illustrated by an arrow J. In this way, the inside of the nozzle 21 and the passages (for circulation) 831 to 833 can also be cleaned with the solvent 69B in the head cleaning processing.

Moreover, in a state where the head cleaning processing of the ink jet recording apparatus 600 is being performed, the pump (for recovery) 34 is operated and electric current is applied to the solenoid valve (for recovery) 50 so that the solenoid valve (for recovery) 50 opens the flow passage. Accordingly, a part of the solvent 69B, which is ejected from the head cleaning nozzle 71 and drops in the directions of the arrows D and E, is sucked from a gutter outlet 25A, which is formed at the gutter 25, and is recovered to the main ink container 31 in a flow direction in which the solvent 69B is sucked as illustrated by an arrow K. In this way, the inside of the gutter 25 and the passages (for the recovery of ink) 811 to 814 can also be cleaned with the solvent 69B in the head cleaning processing.

Figure 12:
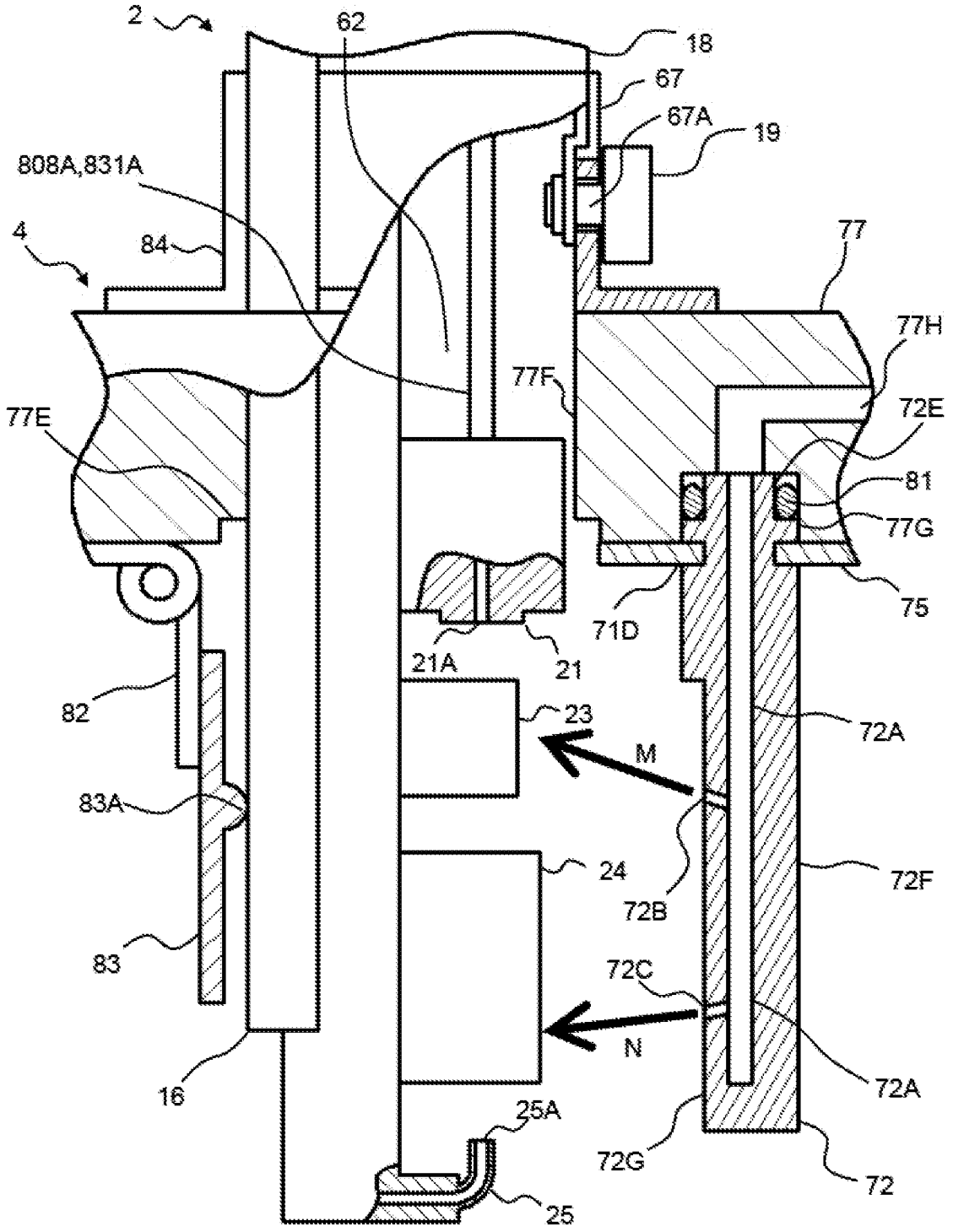
FIG. 12 is an enlarged view illustrating the print head and a drying nozzle when head drying processing of the first embodiment is performed, and the structure therearound.

Next, head drying processing of this embodiment will be described. FIG. 12 is an enlarged view illustrating the print head and the drying nozzle when the head drying processing of this embodiment is performed, and the structure therearound.

In FIG. 12, the ink jet recording apparatus 600 ejects air from the head-drying air nozzle 72 in the head drying processing to perform the drying of the print head 2. In a state where air is being ejected from the head-drying air nozzle 72 in the head drying processing, the pump (for the supply of dry air) 37 is operated and electric current is applied to the solenoid valve (for the supply of dry air) 55 so that the solenoid valve (for the supply of dry air) 55 opens the flow passage. Accordingly, air is ejected from the head-drying air nozzle 72 in the direction of an arrow M (a direction where air is ejected to a gap between the charging electrodes 23 from the air nozzle-ejection hole A portion 72B) and the direction of an arrow N (a direction where air is ejected to the deflecting electrodes 24 from the air nozzle-ejection hole B portion 72C). As a result, a drying time for the print head 2, which is wetted with the solvent 69B in the head cleaning processing, can be shortened.

Figure 13:
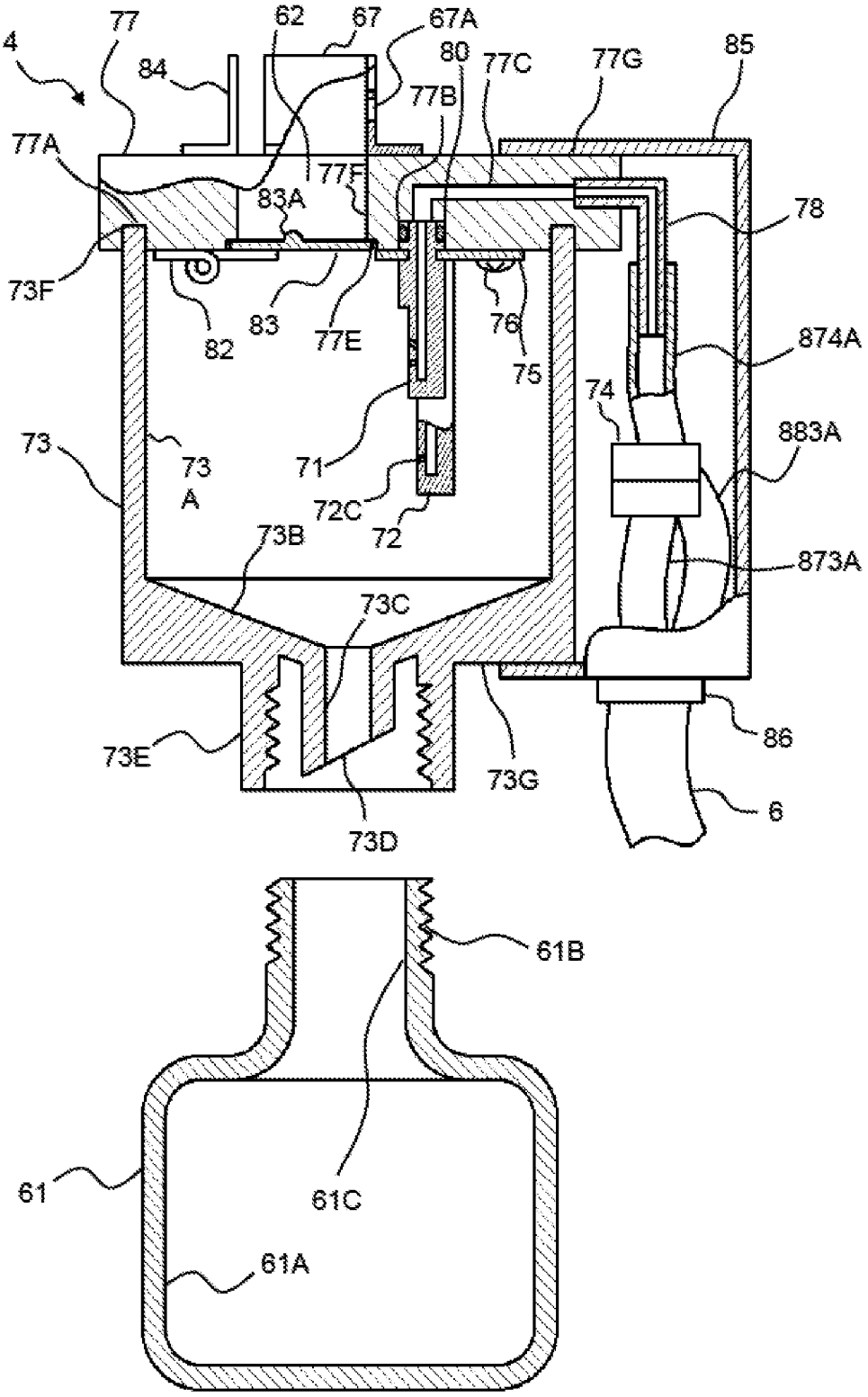
FIG. 13 is a diagram illustrating a state where a cleaning liquid bottle is detached from the head cleaning unit of the first embodiment.

Next, FIG. 13 is a diagram illustrating a state where the cleaning liquid bottle 61 is detached from the head cleaning unit 4 of this embodiment. A female screw portion formed on the cleaning tank-bottle mounting portion 73E of the head cleaning unit 4 and a male screw portion formed on the bottle mounting portion 61B of the cleaning liquid bottle 61 are fitted to each other, so that the cleaning liquid bottle 61 is fixed to the head cleaning unit 4. For this reason, the cleaning liquid bottle 61 can be detached from the head cleaning unit 4 in a case where the cleaning liquid bottle 61 is rotated. Further, the cleaning liquid 69C, which is stored in the cleaning liquid bottle 61 after the head cleaning processing, can be discharged from the bottle-liquid inlet 61C in a case where the cleaning liquid bottle 61 is tilted.

Figure 14:
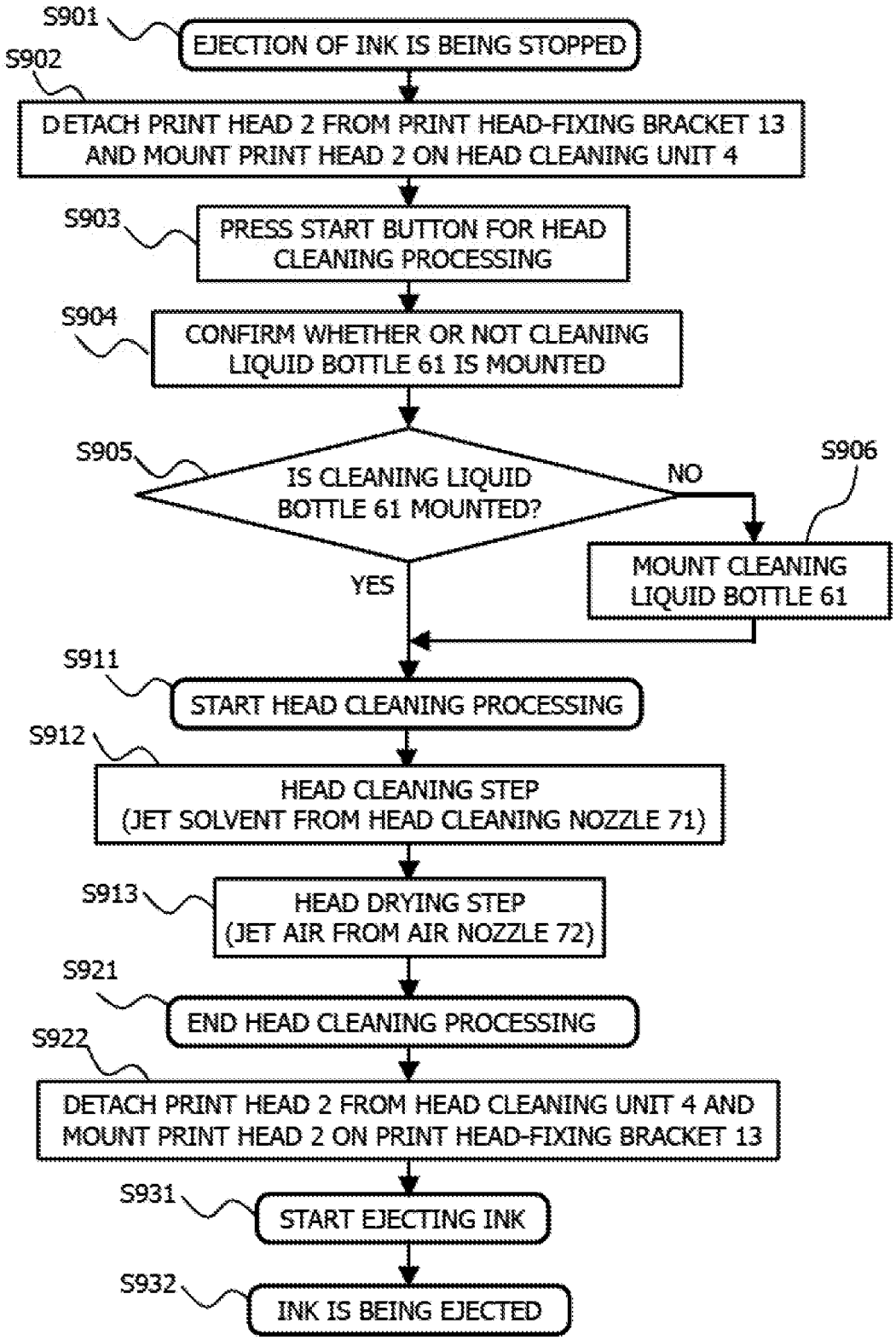
FIG. 14 is a flowchart illustrating a head cleaning operation of the first embodiment.

Next, the flow of the operation of the head cleaning processing of the ink jet recording apparatus 600 according to this embodiment will be described with reference to FIG. 14. FIG. 14 is a flowchart illustrating a head cleaning operation of the first embodiment.

First, in Step S901 of FIG. 14, the ink jet recording apparatus 600 is in a state where the ejection of ink from the nozzle 21 of the print head 2 is stopped and the components of an ink circulation system, such as the pump (for supply) 33 and the solenoid valve (for supply) 49, are not operated since power is not supplied to the components of the ink circulation system.

In Step S902, a worker detaches the print head 2, which is installed on a production facility, from the print head-fixing bracket 13, removes the head cover 17 from the print head 2, and sets the print head 2 on the head cleaning unit 4.

In Step S903, the worker presses the start button 63 of the head cleaning unit 4. Alternatively, the worker presses a start button that is displayed on the touch panel type operation display portion 8 and is used to perform the head cleaning processing.

In Step S904, a message, such as "Please confirm whether or not the cleaning liquid bottle 61 is mounted on the head cleaning unit 4", is displayed on the display part 65 of the head cleaning unit 4 or the operation display portion 8.

In Step S905, the worker confirms the message displayed in Step S904. As a result of the confirmation, if the cleaning liquid bottle 61 is correctly mounted on the head cleaning unit 4, the worker makes the determination of "YES" and presses the start button 63 of the head cleaning unit 4 or an "execution" button displayed on the touch panel type operation display portion 8 to make the processing proceed to Step S911. As a result of the confirmation, if the cleaning liquid bottle is not mounted on the head cleaning unit 4, the worker makes the determination of "NO" to make the processing proceed to Step S906.

In Step S906, after mounting the cleaning liquid bottle 61, the worker presses the start button 63 of the head cleaning unit 4 or an "execution" button displayed on the touch panel type operation display portion 8 to make the processing proceed to Step S911.

In Step S911, a message of "during the head cleaning processing" is displayed on the display part 65 of the head cleaning unit 4 or the operation display portion 8 so that the worker recognizes the start of the head cleaning processing.

Step S912 is a head cleaning step, and ejects the solvent 69B from the head cleaning nozzle 71 of the head cleaning unit 4 to clean the print head 2.

Step S913 is a head drying step, and ejects air from the head-drying air nozzle 72 of the head cleaning unit 4 to dry the print head 2. A drying time for the print head 2 is controlled to an appropriate drying time on the basis of the type of the ink 59A, the type of the solvent 69A, or the condition of the temperature around the print head 2 detected by the temperature sensor 27. For example, a drying time, that is, an air supply time in a service condition where the temperature detected by the temperature sensor 27 is low is set to be longer than that in a service condition where the temperature detected by the temperature sensor 27 is high. The reason for this is that it is difficult to dry the print head 2 at a low temperature.

Then, the worker ends the head cleaning processing in Step S921, and detaches the print head 2 from the head cleaning unit 4 and mounts the print head 2 on the print head-fixing bracket 13 provided on the production facility in Step S922.

In Step S931, the worker presses an "operation start" button displayed on the touch panel type operation display portion 8.

In Step S932, ink is being ejected from the nozzle 21 of the print head 2 and the ink jet recording apparatus 600 is ready to perform printing.

Figure 15:
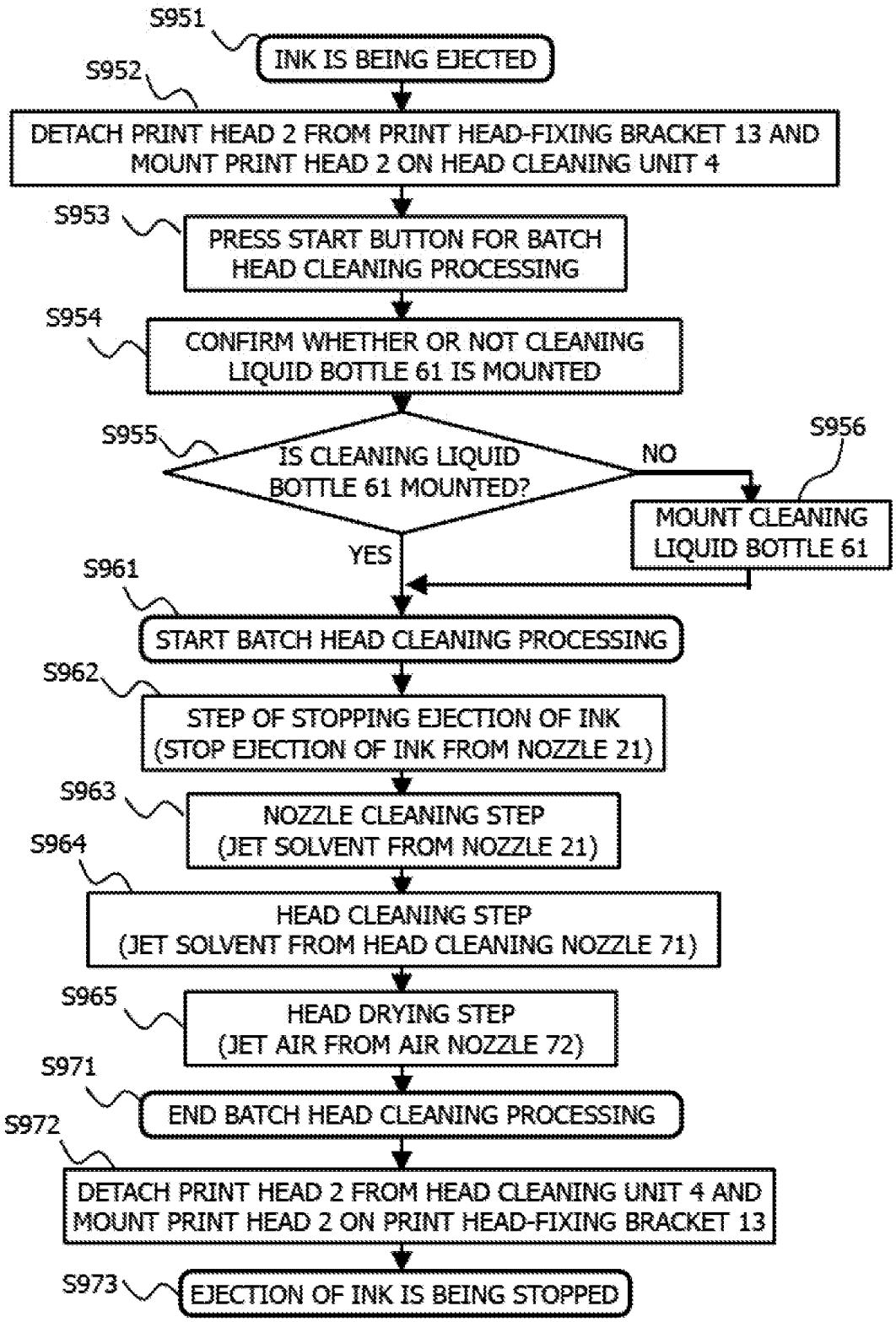
FIG. 15 is a flowchart illustrating batch head cleaning processing of the first embodiment.

Next, the flow of the operation of batch head cleaning processing of the ink jet recording apparatus 600 according to this embodiment will be described with reference to FIG. 15. FIG. 15 is a flowchart illustrating the batch head cleaning processing of this embodiment. In the batch head cleaning processing, the ejection of the ink from the nozzle 21 of the print head 2 is stopped from a state where the ink 59A is being ejected from the nozzle 21 of the print head 2, the solvent 69A is supplied to the nozzle 21 through the switching valve 26 to clean the nozzle 21, and the solvent is then ejected to the print head 2 from the head cleaning nozzle 71 of the head cleaning unit 4 to clean the print head 2.

First, in Step S951 of FIG. 15, the ink 59A is being ejected from the nozzle 21 of the print head 2 installed on the production facility.

In Step S952, the worker detaches the print head 2, which is installed on the production facility, from the print head-fixing bracket 13, removes the head cover 17 from the print head 2, and sets the print head 2 on the head cleaning unit 4.

In Step S953, the worker presses the start button 63 of the head cleaning unit 4. Alternatively, the worker presses a start button that is displayed on the touch panel type operation display portion 8 and is used to perform the head cleaning processing.

In Step S954, a message, such as "Please confirm whether or not the cleaning liquid bottle 61 is mounted on the head cleaning unit 4", is displayed on the display part 65 of the head cleaning unit 4 or the operation display portion 8.

In Step S955, the worker confirms the message displayed in Step S954. As a result of the confirmation, if the cleaning liquid bottle 61 is correctly mounted on the head cleaning unit 4, the worker makes the determination of "YES" and presses the start button 63 of the head cleaning unit 4 or an "execution" button displayed on the touch panel type operation display portion 8 to make the processing proceed to Step S961. As a result of the confirmation, if the cleaning liquid bottle 61 is not mounted on the head cleaning unit 4, the worker makes the determination of "NO" to make the processing proceed to Step S956.

In Step S956, after mounting the cleaning liquid bottle 61, the worker presses the start button 63 of the head cleaning unit 4 or an "execution" button displayed on the touch panel type operation display portion 8 to make the processing proceed to Step S961.

In Step S961, the worker starts batch head cleaning processing. First, Step S962 is a step of stopping the ejection of ink, and performs processing for stopping the ejection of the ink 59A from the nozzle 21 of the print head 2. After that, Step S963 is a nozzle cleaning step, and supplies the solvent 69A to the nozzle 21 of the print head 2 through the switching valve 26 to perform cleaning from the inside of the nozzle 21. Then, Step S964 is a head cleaning step, and ejects the solvent 69B from the head cleaning nozzle 71 of the head cleaning unit 4 to clean the print head 2. Step S965 is a head drying step, and ejects air from the head-drying air nozzle 72 of the head cleaning unit 4 to dry the print head 2. A drying time for the print head 2 is controlled to an appropriate drying time on the basis of the type of the ink 59A, the type of the solvent 69A, or the condition of the temperature around the print head 2 detected by the temperature sensor 27. Then, the worker ends the batch head cleaning processing in Step S971.

In Step S972, the worker detaches the print head 2 from the head cleaning unit 4 and mounts the print head 2 on the print head-fixing bracket 13 provided on the production facility.

In Step S973, the ink jet recording apparatus 600 is in a state where the ejection of ink from the nozzle 21 of the print head 2 is stopped and the components of an ink circulation system, such as the pump (for supply) 33 and the solenoid valve (for supply) 49, are not operated since power is not supplied to the components of the ink circulation system.

According to this embodiment, the ink jet recording apparatus 600 can perform processing from the cleaning of the head up to the drying of the head as a series of flow since the print head 2 is set on the head cleaning unit 4 as described above. Further, the ink jet recording apparatus 600 reduces the moving distance of the print head 2 at the time of the head cleaning operation since the head cleaning unit 4 is installed on the belt conveyor 11 of the production line, and improves the stability of the head cleaning operation since the print head 2 is set on the head cleaning unit 4. Furthermore, the ink jet recording apparatus 600 can have a head cleaning function to also allow the inside of the nozzle 21 to be cleaned by sucking the solvent 69A from the nozzle 21 during the clean of the head.

Second Embodiment

A state where an ink jet recording apparatus 610 according to this embodiment is used will be described with reference to FIGS. 16 and 17. Meanwhile, the description of portions common to the first embodiment will be omitted and a difference between this embodiment and the first embodiment will be mainly described.

Figure 16:
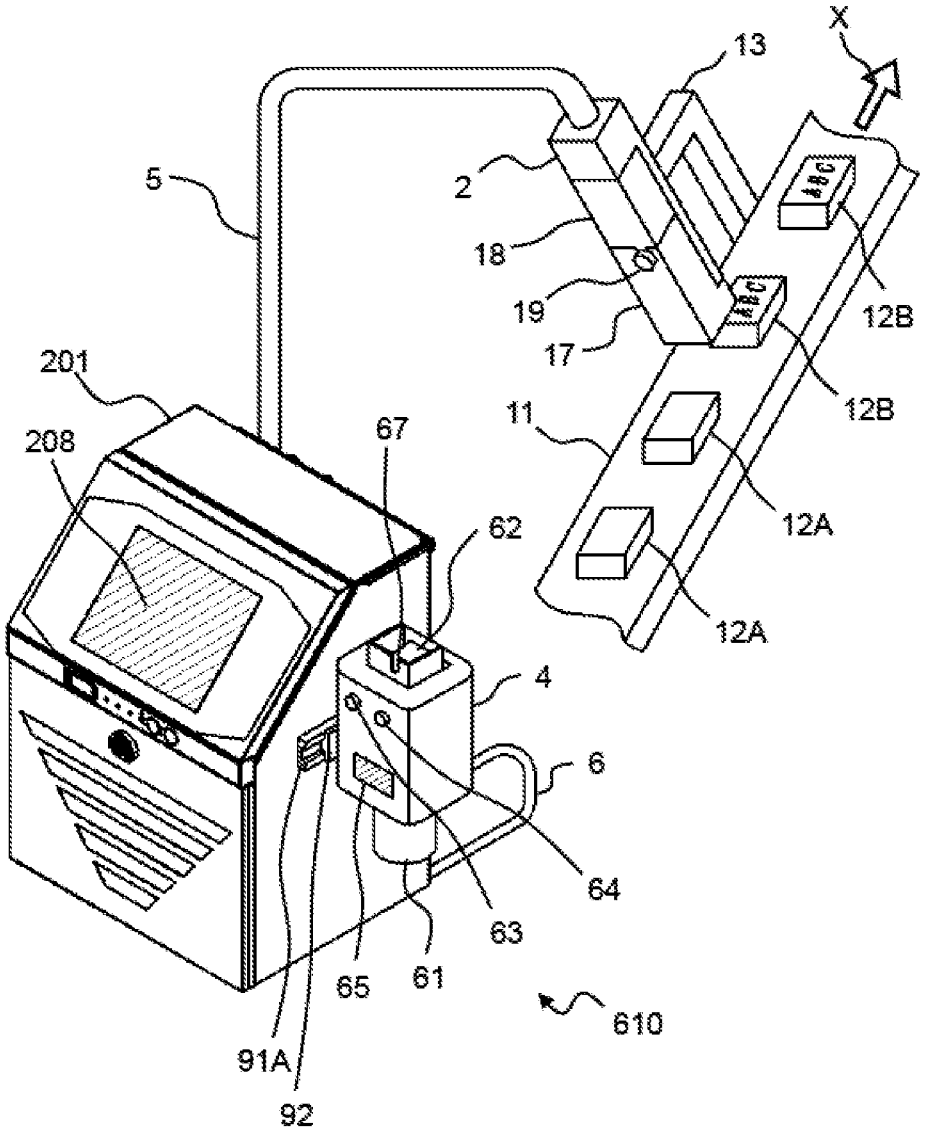
FIG. 16 is a perspective view illustrating a state where an ink jet recording apparatus according to a second embodiment is used.
Figure 17:
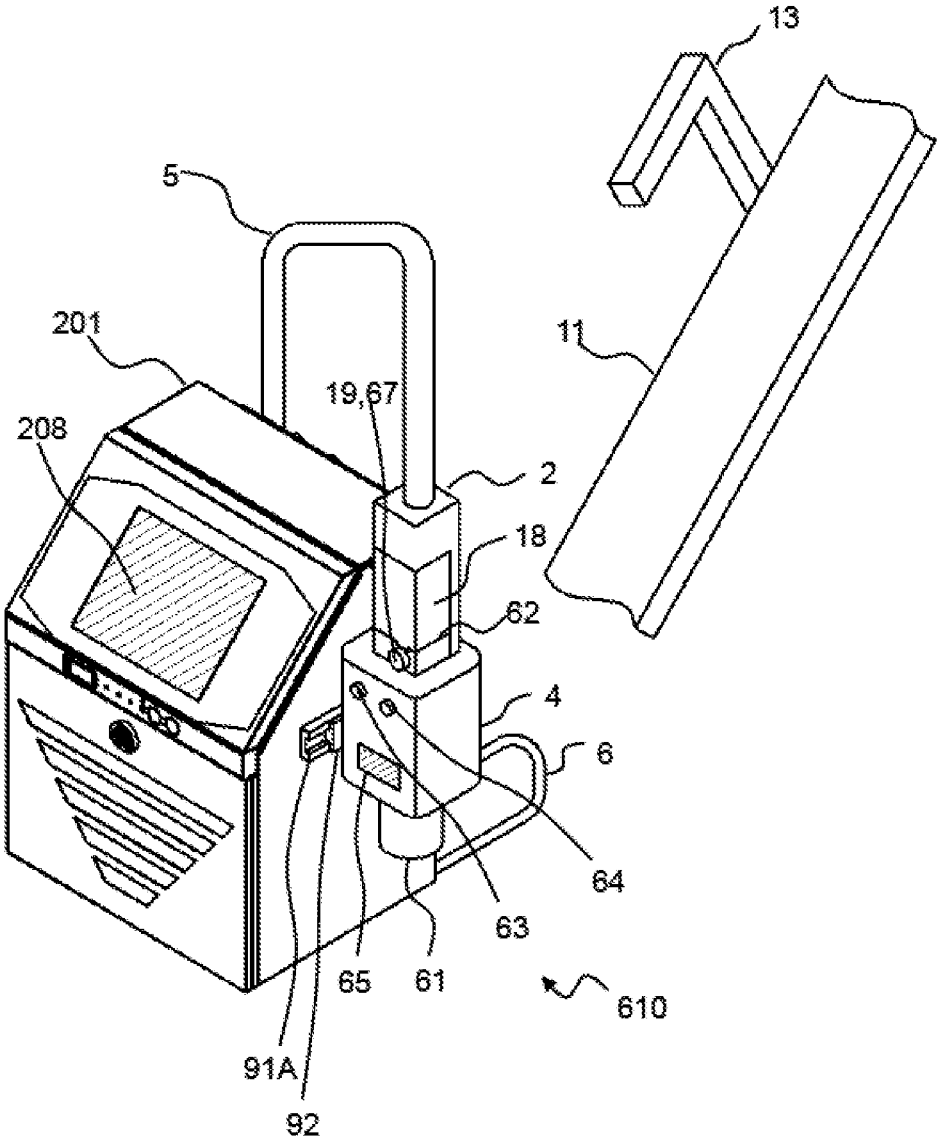
FIG. 17 is a perspective view illustrating a state where a print head of the ink jet recording apparatus according to the second embodiment is set on a head cleaning unit.

FIG. 16 is a perspective view illustrating a state where the ink jet recording apparatus 610 according to this embodiment is used, and FIG. 17 is a perspective view illustrating a state where a print head 2 is set on a head cleaning unit 4 in the ink jet recording apparatus 610 according to this embodiment.

As illustrated in FIG. 16, the ink jet recording apparatus 610 includes an ink jet recording apparatus body 201, a print head 2 that is connected to the ink jet recording apparatus body 201 through a conduit (for a print head) 5, and a head cleaning unit 4 that is connected to the ink jet recording apparatus body 201 through a conduit (for a head cleaning unit) 6. The ink jet recording apparatus body 201 includes an operation display portion 208 that is used for the switching of print settings, the display of a confirmation message and an alarm, and the like, and a head cleaning unit-fixing jig (for a body) 91A that is used to fix the head cleaning unit 4 to the ink jet recording apparatus body 201. Further, the head cleaning unit 4 is installed on the ink jet recording apparatus body 201 through the head cleaning unit-fixing jig (for a body) 91A.

FIG. 17 illustrates a state where the print head 2 is set on the head cleaning unit 4 in the ink jet recording apparatus 610. Since the head cleaning unit 4 is installed on the ink jet recording apparatus body 201, it is possible to realize a structure where a head cleaning operation using the operation display portion 208 is easily performed. Further, since the head cleaning unit 4 can be installed on the ink jet recording apparatus body 201, the head cleaning unit 4 can be used even in a case where a space required for the installation of the head cleaning unit 4 is not present on the production line, such as the belt conveyor 11.

According to this embodiment, the ink jet recording apparatus 610 is adapted so that the head cleaning unit 4 is installed on the ink jet recording apparatus body 201 as described above, it is possible to provide the ink jet recording apparatus 610 that is improved in the handleability and installability of the head cleaning unit 4.

Third Embodiment

A state where an ink jet recording apparatus 620 according to this embodiment is used will be described with reference to FIG. 18. Meanwhile, the description of portions common to the first and second embodiments will be omitted and a difference between this embodiment and the first and second embodiments will be mainly described.

Figure 18:
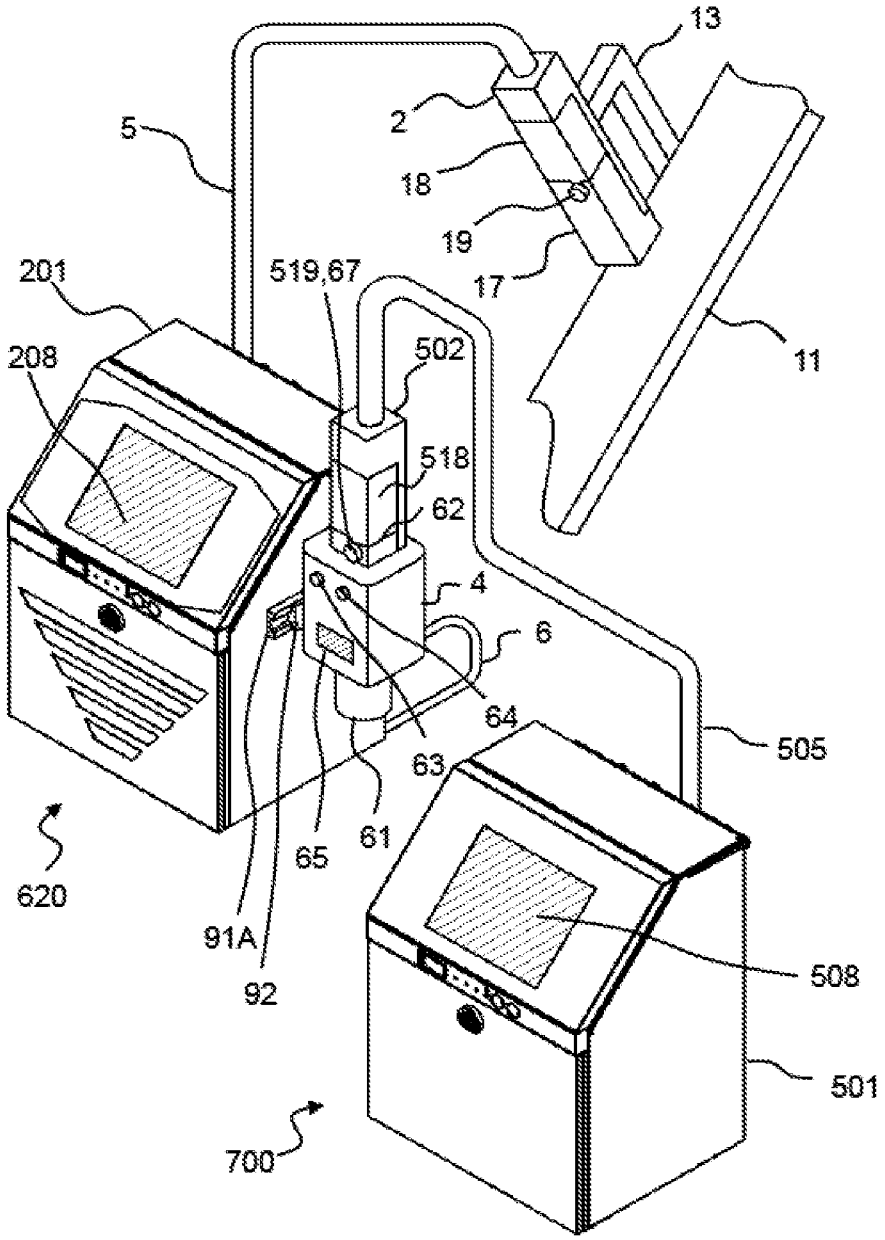
FIG. 18 is a diagram illustrating a state where a print head of another apparatus is set on a head cleaning unit and the cleaning of the head is performed in an ink jet recording apparatus according to a third embodiment.

FIG. 18 is a diagram illustrating a state where a print head 502 of another ink jet recording apparatus 700 is set on a head cleaning unit 4 and the cleaning of the head is performed in the ink jet recording apparatus 620 according to this embodiment.

As illustrated in FIG. 18, the head cleaning unit 4 is installed on an ink jet recording apparatus body 201 through a head cleaning unit-fixing jig (for a body) 91A in the ink jet recording apparatus 620. Further, the ink jet recording apparatus 700 is installed near the ink jet recording apparatus 620. The ink jet recording apparatus 700 includes an ink jet recording apparatus body 501, a print head 502 that is connected to the ink jet recording apparatus body 501 through a conduit (for a print head) 505, and an operation display portion 508 that is used for the switching of print settings, the display of a confirmation message and an alarm, and the like.

Further, the print head 502 of the ink jet recording apparatus 700 is set on the head cleaning unit 4 of the ink jet recording apparatus 620. The print head 502 is inserted into the print head-insertion portion 62 of the head cleaning unit 4 from the end of the print head 502 in a state where a head cover 517 is detached. Then, the print head-fixing part 67 and a fixing knob 519 are fitted to each other, so that the print head 502 is fixed to and mounted on the head cleaning unit 4. In a case where a worker operates the operation display portion 208 of the ink jet recording apparatus 620 or presses the start button 63 of the head cleaning unit 4 in this state, the control of the cleaning of the head can be performed.

According to this embodiment, since the ink jet recording apparatus 620 is adapted so that the print head 502 of another ink jet recording apparatus 700 can also be set and cleaned, it is possible to provide an ink jet recording apparatus of which the usability is improved.

The embodiments have been described above, but the invention is not limited to the above-mentioned first to third embodiments and includes various modifications. Further, the above-mentioned first to third embodiments have been described in detail for easy understanding of the invention, and the invention is not necessarily limited to a structure including all the above-mentioned components.

What is claimed is:

1. An ink jet recording apparatus comprising:

an ink container in which ink to be used to perform printing on a print target is stored;

a nozzle which is connected to the ink container and from which pressurized and supplied ink is jetted;

charging electrodes that charge ink particles jetted from the nozzle with electricity;

deflecting electrodes that polarize the ink particles charged with electricity by the charging electrodes;

a gutter that recovers ink not used for printing;

a solvent container in which a solvent is stored; and a liquid nozzle which is connected to the solvent container and from which a pressurized and supplied solvent is jetted, wherein the liquid nozzle includes a liquid flow passage portion that extends from the nozzle in a direction of the gutter, and a liquid jet hole that is formed at an angle allowing the pressurized and supplied solvent to hit the nozzle through the liquid flow passage portion, and wherein the liquid flow passage portion is formed in parallel to a flight direction of ink that is jetted from the nozzle and is recovered from the gutter.

2. The ink jet recording apparatus according to claim 1, further comprising:

a head base on which the nozzle, the charging electrodes, and the deflecting electrodes are placed, wherein the liquid flow passage portion is disposed on one side of the nozzle, the charging electrodes, and the deflecting electrodes opposite to the head base.

3. The ink jet recording apparatus according to claim 1, wherein the liquid nozzle includes a second liquid jet hole that is formed at an angle allowing the solvent to hit the deflecting electrodes.

4. The ink jet recording apparatus according to claim 1, further comprising:

an air nozzle that jets air to be used to dry a part of the solvent jetted from the liquid nozzle.

5. The ink jet recording apparatus according to claim 4, wherein the air nozzle includes an air jet hole that is formed at an angle allowing a flow of the jetted air to hit the charging electrodes.

6. The ink jet recording apparatus according to claim 4, wherein the air nozzle includes an air flow passage portion that extends from the nozzle in a direction of the gutter when the air is supplied.

7. The ink jet recording apparatus according to claim 4, wherein an air supply time, in which the air is supplied from the air nozzle, is changed according to the type of the ink stored in the ink container or the type of the solvent stored in the solvent container.

8. The ink jet recording apparatus according to claim 4, further comprising:

a temperature sensor that is used to determine an air supply time in which the air is supplied from the air nozzle.

9. The ink jet recording apparatus according to claim 8, wherein the air supply time in a service condition where a temperature detected by the temperature sensor is low is set to be longer than that in a service condition where a temperature detected by the temperature sensor is high.

10. The ink jet recording apparatus according to claim 1, wherein the ink container and the solvent container are installed on a body, the nozzle, the charging electrodes, the deflecting electrodes, and the gutter are installed on a print head that is provided separately from the body, and the liquid nozzle is installed on a cleaning unit that is provided separately from the body and the print head.

11. The ink jet recording apparatus according to claim 10, wherein the cleaning unit includes a cleaning tank in which the print head is to be received, and a print head-insertion portion that is used to mount the print head on the cleaning unit.

12. The ink jet recording apparatus according to claim 11, wherein the print head-insertion portion is formed in a lid block connected to the cleaning tank, and the liquid nozzle is assembled to the lid block.

13. The ink jet recording apparatus according to claim 12, wherein the cleaning unit includes a lid member that is used to open and close the print head-insertion portion.

14. The ink jet recording apparatus according to claim 11, wherein the cleaning tank includes a liquid outflow hole that is formed in a bottom thereof, and an inner bottom that is formed obliquely.

15. The ink jet recording apparatus according to claim 10, wherein an air nozzle, which jets air to be used to dry a part of the solvent jetted from the liquid nozzle, assembled to the cleaning unit.

16. The ink jet recording apparatus according to claim 10, wherein a bottle, which is capable of storing the solvent jetted from the liquid nozzle, is capable of being installed on a lower portion of the cleaning unit.

17. The ink jet recording apparatus according to claim 10, wherein the cleaning unit is connected to the body through a conduit for the cleaning unit.

18. The ink jet recording apparatus according to claim 17, wherein the print head is connected to the body through a conduit for the print head, and the length of the conduit for the cleaning unit is equal to or longer than the length of the conduit for the print head.

19. The ink jet recording apparatus according to claim 10, wherein the cleaning unit includes a start button that is used to start jetting the solvent from the liquid nozzle, and a stop button that is used to stop jetting the solvent when the solvent is being jetted from the liquid nozzle.

20. The ink jet recording apparatus according to claim 10, wherein the cleaning unit includes a fixing jig that is used to mount the cleaning unit on the body.

21. The ink jet recording apparatus according to claim 1, wherein a part of the solvent, which is jetted from the liquid nozzle, is sucked from the nozzle, so that the surface and inside of the nozzle are cleaned.

22. An ink jet recording apparatus comprising:

an ink container in which ink to be used to perform printing on a print target is stored;

a nozzle which is connected to the ink container and from which pressurized and supplied ink is jetted;

charging electrodes that charge ink particles jetted from the nozzle with electricity;

deflecting electrodes that polarize the ink particles charged with electricity by the charging electrodes;

a gutter that recovers ink not used for printing;

a solvent container in which a solvent is stored; and a liquid nozzle which is connected to the solvent container and from which a pressurized and supplied solvent is jetted, wherein the liquid nozzle includes a liquid flow passage portion that extends from the nozzle in a direction of the gutter, and a liquid jet hole that is formed at an angle allowing the pressurized and supplied solvent to hit the nozzle through the liquid flow passage portion, and wherein the liquid nozzle includes an outer portion that is formed in a columnar shape, and a planar portion that is connected to the outer portion and the liquid jet hole.

* * * * *